US011806987B2

(12) United States Patent
Watanabe

(10) Patent No.: US 11,806,987 B2
(45) Date of Patent: Nov. 7, 2023

(54) LIQUID EJECTING HEAD AND LIQUID EJECTING APPARATUS

(71) Applicant: Seiko Epson Corporation, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 241 days.

(21) Appl. No.: 17/346,349

(22) Filed: Jun. 14, 2021

(65) Prior Publication Data

US 2021/0394521 A1 Dec. 23, 2021

(30) Foreign Application Priority Data

Jun. 17, 2020 (JP) ..... 2020-104700

(51) Int. Cl.
*B41J 2/175* (2006.01)
*B41J 2/135* (2006.01)

(52) U.S. Cl.
CPC ..... *B41J 2/17563* (2013.01); *B41J 2/135* (2013.01)

(58) Field of Classification Search
CPC ..... B41J 2/17563; B41J 2/135
See application file for complete search history.

(56) References Cited

U.S. PATENT DOCUMENTS 6,663,222 B2 * 12/2003 Verhoest ..... B41J 25/001 347/42
2016/0059576 A1 3/2016 Ito et al.
2017/0282553 A1 10/2017 Hayashi et al.
2017/0282562 A1 10/2017 Mizuno et al.
2018/0009218 A1 1/2018 Tamura et al.
2019/0016148 A1 1/2019 Akahane
2020/0070538 A1 3/2020 Funada et al.
2020/0079086 A1 3/2020 Asai et al.

FOREIGN PATENT DOCUMENTS

| | | |
|---|---|---|
| EP | 3686013 | 7/2020 |
| JP | 2011-079170 | 4/2011 |
| JP | 2012-254551 | 12/2012 |
| JP | 2015-030181 | 2/2015 |
| JP | 2016-049725 | 4/2016 |
| JP | 2018-043369 | 3/2018 |
| JP | 2019-014212 | 1/2019 |
| JP | 2020-032677 | 3/2020 |

* cited by examiner

*Primary Examiner* — Thinh H Nguyen
(74) *Attorney, Agent, or Firm* — WORKMAN NYDEGGER

(57) ABSTRACT

A liquid ejecting head includes: a nozzle face; a filter; a downstream chamber that includes a first outlet and a second outlet for discharging the liquid, the downstream chamber being located downstream of the filter; a first flow passage that is in communication with the downstream chamber through the first outlet; a second flow passage that is in communication with the downstream chamber through the second outlet; and a common flow passage that is in communication with the first flow passage and the second flow passage, wherein, as viewed perpendicularly to the nozzle face, the first outlet is located at a position that is shifted from a center of the downstream chamber in a first direction, and the second outlet is located at a position that is shifted from the center of the downstream chamber in a second direction that is opposite of the first direction.

20 Claims, 15 Drawing Sheets

LIQUID EJECTING HEAD AND LIQUID EJECTING APPARATUS

The present application is based on, and claims priority from JP Application Serial Number 2020-104700, filed Jun. 17, 2020, the disclosure of which is hereby incorporated by reference herein in its entirety.

BACKGROUND

1. Technical Field

Embodiments of the present disclosure relate to a liquid ejecting head and a liquid ejecting apparatus.

2. Related Art

A liquid ejecting apparatus that includes a liquid ejecting head configured to eject liquid is known in related art. A typical example is an ink-jet printer that ejects ink. For example, a liquid ejecting head disclosed in JP-A-2018-043369 includes a liquid inlet member via which liquid is supplied into a liquid flow passage. The liquid flow passage is in communication with nozzles from which the liquid is ejected. The liquid inlet member includes a filter chamber, a filter, and a filter downstream chamber. An inlet through which liquid flows in is provided on the filter chamber. The filter is configured to filter the liquid that has flowed in through the inlet. The filter downstream chamber has an opening through which the liquid having passed through the filter goes out.

JP-A-2011-079170 discloses an apparatus that includes four ink-jet heads arranged around a drum that rotates to transport a sheet.

In the apparatus disclosed in JP-A-2011-079170, each of the four ink-jet heads is installed in an inclined orientation with respect to a horizontal plane. A case where, for example, the liquid ejecting head disclosed in JP-A-2018-043369 is applied to the apparatus disclosed in JP-A-2011-079170 can be anticipated. However, the following technical issue needs to be solved. In the liquid ejecting head disclosed in JP-A-2018-043369, the opening through which the liquid goes out is located at the center portion of the filter downstream chamber. Therefore, if the liquid ejecting head disclosed in JP-A-2018-043369 is used in an inclined state with respect to the horizontal plane, air bubbles will stay inside the filter downstream chamber at a portion that is above the opening.

SUMMARY

A liquid ejecting head according to a certain aspect of the present disclosure includes: a nozzle face that has a plurality of nozzles from which liquid is ejected; a filter through which the liquid passes; a downstream chamber that includes a first outlet and a second outlet for discharging the liquid, the downstream chamber being located downstream of the filter, the filter constituting a part of a wall surface of the downstream chamber; a first flow passage that is in communication with the downstream chamber through the first outlet; a second flow passage that is in communication with the downstream chamber through the second outlet; and a common flow passage that is in communication with the first flow passage and the second flow passage, wherein in plan view perpendicular to the nozzle face, the first outlet is located at a position that is shifted from a center of the downstream chamber in a first direction, and the second outlet is located at a position that is shifted from the center of the downstream chamber in a second direction that is opposite of the first direction.

A liquid ejecting head according to another aspect of the present disclosure includes: a nozzle face that has a plurality of nozzles from which liquid is ejected; a filter through which the liquid passes; a downstream chamber that includes a first outlet, a second outlet, and a third outlet for discharging the liquid, the downstream chamber being located downstream of the filter, the filter constituting a part of a wall surface of the downstream chamber; a first flow passage that is in communication with the downstream chamber through the first outlet; a second flow passage that is in communication with the downstream chamber through the second outlet; a third flow passage that is in communication with the downstream chamber through the third outlet; and a common flow passage that is in communication with the first flow passage, the second flow passage, and the third flow passage.

A liquid ejecting apparatus according to a certain aspect of the present disclosure includes: the liquid ejecting head according to either one of the above aspects; and a transport mechanism that transports a medium.

DESCRIPTION OF EXEMPLARY EMBODIMENTS

Figure 1:
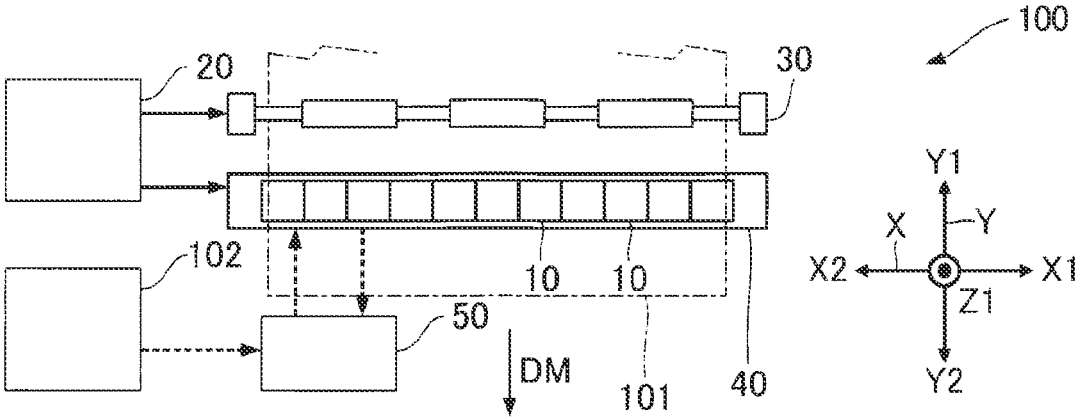
FIG. 1 is a schematic diagram that illustrates an example of the configuration of a liquid ejecting apparatus according to a first embodiment.

With reference to the accompanying drawings, some preferred embodiments of the present disclosure will now be described. The dimensions or scales of parts illustrated in the drawings may be different from actual dimensions or scales, and some parts may be schematically illustrated for easier understanding. The scope of the present disclosure shall not be construed to be limited to these specific examples unless and except where the description below contains an explicit mention of limiting the present disclosure.

The description below is given with reference to X, Y, and Z axes intersecting with one another. One direction along the X axis will be referred to as the X1 direction. The direction that is the opposite of the X1 direction will be referred to as the X2 direction. Similarly, directions that are the opposite of each other along the Y axis will be referred to as the Y1 direction and the Y2 direction. Directions that are the opposite of each other along the Z axis will be referred to as the Z1 direction and the Z2 direction. The Y2 direction is an example of "a first direction". The Y1 direction is an example of "a second direction". The X1 direction or the X2 direction is an example of "a third direction".

Typically, the Z axis is a vertical axis, and the Z2 direction corresponds to a vertically downward direction. However, the Z axis does not necessarily have to be a vertical axis. The Z axis may be inclined with respect to the vertical axis. The X, Y, and Z axes are typically orthogonal to one another, but are not limited thereto. It is sufficient as long as the X, Y, and Z axes intersect with one another within an angular range of, for example, 80° or greater and 100° or less.

1. First Embodiment

1-1. Liquid Ejecting Apparatus 100

FIG. 1 is a schematic diagram that illustrates an example of the configuration of a liquid ejecting apparatus 100 according to a first embodiment. The liquid ejecting apparatus 100 is an ink-jet-type printing apparatus that ejects droplets of ink, which is an example of liquid, onto a medium 101. The liquid ejecting apparatus 100 according to the present embodiment is a so-called line-type printing apparatus in which plural nozzles configured to eject ink are provided throughout the entire width of the medium 101. A typical example of the medium 101 is printing paper. The medium 101 is not limited to printing paper. The medium 12 may be a print target made of any material such as, for example, a resin film or a cloth.

As illustrated in FIG. 1, a liquid container 102 that contains ink is attached to the liquid ejecting apparatus 100. Some specific examples of the liquid container 102 are: a cartridge that can be detachably attached to the liquid ejecting apparatus 100, a bag-type ink pack made of a flexible film material, an ink tank which can be refilled with ink, etc. Any type of ink may be contained in the liquid container 102.

The liquid container 102 according to the present embodiment includes a first liquid container and a second liquid container, though not illustrated. The first liquid container contains first ink. The second liquid container contains second ink, the type of which is different from the type of the first ink. For example, the color of the first ink and the color of the second ink are different from each other. The first ink and the second ink may be the same type of ink.

The liquid ejecting apparatus 100 includes a control unit 20, a transport mechanism 30, a liquid ejecting module 40, and a circulation mechanism 50. The control unit 20 controls the operation of each component of the liquid ejecting apparatus 100. The control unit 20 includes a processing circuit, for example, a CPU (central processing unit) or an FPGA (field programmable gate array), and a storage circuit such as a semiconductor memory. Various kinds of program and data are stored in the storage circuit. The processing circuit realizes various kinds of control by running the program and using the data.

The transport mechanism 30 transports the medium 101 in a direction DM in accordance with control by the control unit 20. The direction DM according to the present embodiment is the Y2 direction. In the example illustrated in FIG. 1, the transport mechanism 30 includes a transport roller that is elongated along the X axis and a motor that rotates the transport roller. The configuration of the transport mechanism 30 is not limited to the illustrated example in which the transport roller is used. For example, a drum that transports the medium 101 in a state in which the medium 101 is attracted to the circumferential surface of the drum due to an electrostatic force, etc., or an endless belt, may be used instead.

Ink is supplied from the liquid container 102 to the liquid ejecting module 40 via the circulation mechanism 50. In accordance with control by the control unit 20, the liquid ejecting module 40 ejects the supplied ink from each of a plurality of nozzles toward the medium 101 in the Z2 direction. The liquid ejecting module 40 is a line head that includes a plurality of liquid ejecting heads 10 arranged such that the nozzles are distributed throughout the entire width of the medium 101 in the direction of the X axis. That is, these liquid ejecting heads 10 constitute a line head that is elongated in the direction in which the X axis extends. Concurrently with the transportation of the medium 101 by the transport mechanism 30, ink is ejected from the plurality of liquid ejecting heads 10. As a result of this concurrent operation, an image is formed using ink on the surface of the medium 101. The liquid ejecting module 40 may be a non-multi-head-type line head that is elongated in the direction in which the X axis extends. That is, the liquid ejecting module 40 may include only a single liquid ejecting head 10 arranged such that the nozzles are distributed throughout the entire width of the medium 101 in the direction in which the X axis extends.

In the example illustrated in FIG. 1, the liquid container 102 is connected indirectly to the liquid ejecting module 40, with the circulation mechanism 50 provided therebetween. The circulation mechanism 50 is a mechanism that supplies ink to the liquid ejecting module 40 and collects ink discharged from the liquid ejecting module 40 for the purpose of supplying the collected ink to the liquid ejecting module 40 again. The circulation mechanism 50 includes, for example, a sub tank that contains ink, a supply flow passage through which ink is supplied from the sub tank to the liquid ejecting module 40, a collection flow passage through which ink is collected into the sub tank from the liquid ejecting module 40, and a pump for causing ink to flow. These components are provided individually for each of the first ink and the second ink mentioned above. The above operation of the circulation mechanism 50 makes it possible to suppress an increase in the viscosity of ink and reduce the stay of air bubbles in ink.

The liquid ejecting apparatus 100 may include a maintenance mechanism that is used for maintenance operation of the liquid ejecting module 40. The maintenance operation includes, for example, flushing operation and cleaning operation. The flushing operation is operation of forcibly ejecting ink that does not directly contribute to the forming of an image from a plurality of nozzles. The cleaning operation is operation of forcibly discharging ink that is present inside the liquid ejecting module 40 from a plurality of nozzles either by applying pressure from the upstream relative to the liquid ejecting module 40 or by applying a suction force from the downstream relative to the liquid ejecting module 40. The maintenance mechanism includes a flushing box that receives ink ejected from each nozzle N when the flushing operation is performed and a cap for hermetically sealing the plurality of nozzles N when the cleaning operation is performed.

As described above, the liquid ejecting apparatus 100 includes the liquid ejecting heads 10, and the transport mechanism 30 that transports the medium 101. The transport mechanism 30 transports the medium 101 in the Y2 direction at a position facing the liquid ejecting heads 10. The liquid ejecting apparatus 100 according to the present embodiment includes the liquid ejecting module 40 as an example of a line head. The liquid ejecting module 40 includes the liquid ejecting heads 10. The liquid ejecting module 40 is elongated in a direction intersecting with the Y2 direction. In the present embodiment, the liquid ejecting module 40 includes the liquid ejecting heads 10 and is elongated in a direction orthogonal to the Y2 direction.

1-2. Liquid Ejecting Module 40

Figure 2:
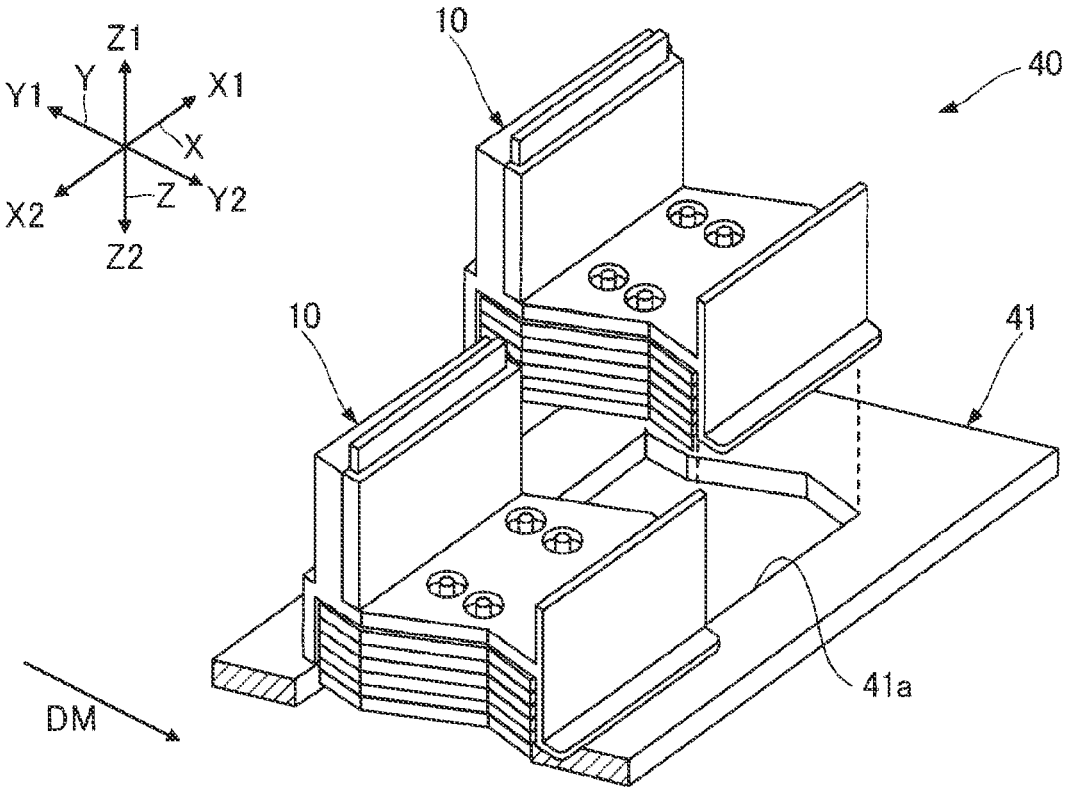
FIG. 2 is a perspective view of a liquid ejecting module that includes liquid ejecting heads according to the first embodiment.

FIG. 2 is a perspective view of the liquid ejecting module 40 that includes the liquid ejecting heads 10 according to the first embodiment. As illustrated in FIG. 2, the liquid ejecting module 40 includes a support 41 and the plurality of liquid ejecting heads 10. The support 41 is a member that supports the plurality of liquid ejecting heads 10. In the example illustrated in FIG. 2, the support 41 is a plate-like member made of metal, etc. The support 41 has a mount hole 41*a* for mounting the plurality of liquid ejecting heads 10. The plurality of liquid ejecting heads 10 is mounted in the mount hole 41*a* in a state of being arranged in a row in the direction along the X axis. Each of the plurality of liquid ejecting heads 10 is fastened to the support 41 by screws, etc. In FIG. 2, two liquid ejecting heads 10 are illustrated as a representative example. The liquid ejecting module 40 may include any number of the liquid ejecting heads 10. The shape, etc. of the support 41 is also not limited to the example illustrated in FIG. 2. The support 41 may have any shape, etc.

1-3. Liquid Ejecting Head 10

Figure 3:
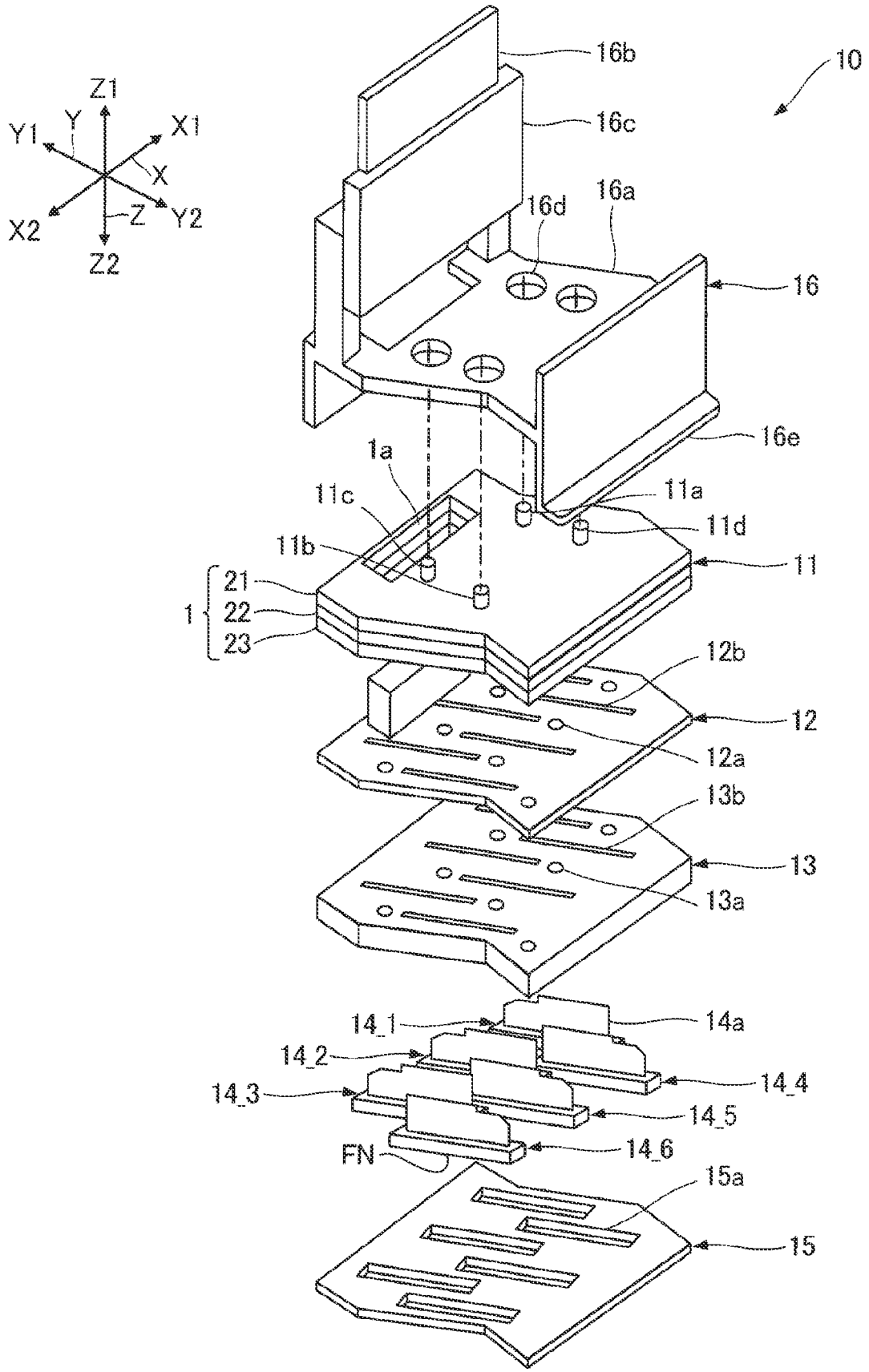
FIG. 3 is an exploded perspective view of the liquid ejecting head illustrated in FIG. 2.

FIG. 3 is an exploded perspective view of the liquid ejecting head 10 illustrated in FIG. 2. As illustrated in FIG. 3, the liquid ejecting head 10 includes a flow passage structure body 11, a wiring board 12, a holder 13, a plurality of head bodies 14_1, 14_2, 14_3, 14_4, 14_5, and 14_6, a fixing plate 15, and a base 16. These components are disposed in the following order as viewed toward Z2: the base 16, the flow passage structure body 11, the wiring board 12, the holder 13, the plurality of head bodies 14_1, 14_2, 14_3, 14_4, 14_5, and 14_6, and, finally, the fixing plate 15. The components of the liquid ejecting head 10 will be described below sequentially. In the description below, each individual one of the plurality of head bodies 14_1, 14_2, 14_3, 14_4, 14_5, and 14_6 is sometimes simply referred to as "head body 14".

The flow passage structure body 11 is a structure body inside which flow passages for flow of ink between the circulation mechanism 50 and the plurality of head bodies 14 are provided. As illustrated in FIG. 3, the flow passage structure body 11 includes a flow passage member 1 and connection pipes 11*a*, 11*b*, 11*c*, and 11*d*. A supply flow passage for supplying the first ink to the plurality of head bodies 14, a supply flow passage for supplying the second ink to the plurality of head bodies 14, a discharge flow passage for discharging the first ink from the plurality of head bodies 14, and a discharge flow passage for discharging the second ink from the plurality of head bodies 14 are provided inside the flow passage member 1, though not illustrated in FIG. 3. A filter for catching a foreign object, etc. "en route" is provided on a path of each supply flow passage. The internal structure of the flow passage member 1 will be described in detail later.

The flow passage member 1 has layers 21, 22, and 23. They constitute a stack of layers in this order as viewed toward Z2. Flow passages such as supply flow passages and discharge flow passages are formed by providing grooves or holes, etc. in these layers. Each of the layers 21, 22, and 23 is, for example, made of a resin material and is formed by injection molding. The layers 21, 22, and 23 are bonded to each other with an adhesive, for example. The thickness of the layers 21, 22, and 23 along the Z axis may be the same as one another or different from one another.

The flow passage member 1 has a plate-like shape with a plane perpendicular to the Z axis. In the example illustrated in FIG. 3, the flow passage member 1 has a hole 1*a*, into which a connector 12*c* described later is inserted. The flow passage member 1 described above has a surface facing in the Z1 direction, and the connection pipes 11*a*, 11*b*, 11*c*, and 11*d* protrude from this surface.

The connection pipe 11*a* is a pipe that constitutes a flow passage for supplying the first ink to the flow passage member 1. The connection pipe 11*b* is a pipe that constitutes a flow passage for supplying the second ink to the flow passage member 1. The connection pipe 11*c* is a pipe that constitutes a flow passage for discharging the first ink from the flow passage member 1. The connection pipe 11*d* is a pipe that constitutes a flow passage for discharging the second ink from the flow passage member 1.

The wiring board 12 is a mount component for electric connection between the plurality of head bodies 14 and a congregated board 16*b* described later. For example, the wiring board 12 is a rigid wiring board. The wiring board 12 is disposed between the flow passage structure body 11 and the holder 13. The wiring board 12 has a surface facing the flow passage structure body 11. On this surface, the connector 12*c* is provided. The connector 12*c* is a connection component coupled to the congregated board 16*b* described later. The wiring board 12 has a plurality of holes 12*a* and a plurality of openings 12*b*. Each of the plurality of holes 12*a* is a hole that allows connection between the flow passage structure body 11 and the holder 13. Each of the plurality of openings 12*b* is a slit through which a wiring member 14*a* for connection between the head body 14 and the wiring board 12 is inserted. The wiring board 12 has a surface facing in the Z1 direction, and the wiring member 14*a* is connected to this surface. The wiring member 14*a* is a member that includes wiring for electric connection to a drive element Ea or Eb described later. The wiring member 14*a* is, for example, an FPC (Flexible Printed Circuit) or a COF (Chip On Film), etc.

The holder 13 is a structure component that houses and supports the plurality of head bodies 14. The holder 13 is made of, for example, a resin material or a metal material, etc. The holder 13 has a plate-like shape with a plane perpendicular to the Z axis. The holder 13 has a plurality of ink holes 13*a* and a plurality of wiring holes 13*b*. Each of the plurality of ink holes 13*a* is a flow-passage-structure-body-side opening in a flow passage through which ink flows between the head body 14 and the flow passage structure body 11. Each of the plurality of wiring holes 13*b* is a slit through which the wiring member 14*a* for connection between the head body 14 and the wiring board 12 is inserted. The holder 13 has the following flow passages inside, though not illustrated: a supply flow passage through which the first ink is supplied to the head body 14, a supply flow passage through which the second ink is supplied to the head body 14, a circulation flow passage for allowing the first ink to flow from the head body 14 to a discharge flow passage CM of the flow passage structure body 11, and a circulation flow passage for allowing the second ink to flow from the head body 14 to a discharge flow passage CM of the flow passage structure body 11. In addition, a branch flow passage for distribution or gathering of ink between each ink hole 13*a* and the plurality of head bodies 14 is provided inside the holder 13, though not illustrated. The holder 13 has a surface facing in the Z2 direction, and, in this surface, a plurality of recesses for accommodating the plurality of head bodies 14 respectively is provided, though not illustrated.

Each of the plurality of head bodies 14 ejects ink. Specifically, though not illustrated in FIG. 3, each of the plurality of head bodies 14 has a plurality of nozzles through which the first ink is ejected and a plurality of nozzles through which the second ink is ejected. These nozzles are provided in a nozzle face FN. The nozzle face FN is the surface, of each of the plurality of head bodies 14, facing in the Z2 direction. The structure of the head body 14 will be described later. View in the direction perpendicular to the nozzle face FN will be simply referred to as "plan view".

The fixing plate 15 is a plate member for fixing the plurality of head bodies 14 to the holder 13. Specifically, the fixing plate 15 is positioned such that the plurality of head bodies 14 is interposed between the holder 13 and the fixing plate 15. Then, the fixing plate 15 is fixed to the holder 13 with an adhesive. The fixing plate 15 is made of, for example, a metal material, etc. The fixing plate 15 has a plurality of openings 15*a* for exposure of the nozzles of the plurality of head bodies 14. In the example illustrated in FIG. 3, each of the plurality of openings 15*a* is provided individually for the corresponding one of the plurality of head bodies 14. The opening 15*a* may be shared by two or more head bodies 14.

The base 16 is a member for fixing the flow passage structure body 11, the wiring board 12, the holder 13, the plurality of head bodies 14, and the fixing plate 15 to the support 41 described earlier. The base 16 includes a base body 16*a*, the congregated board 16*b*, and a cover 16*c*.

By being fastened to the holder 13 by screws, etc., the base body 16*a* holds the flow passage structure body 11 and the wiring board 12, which are disposed between the base 16 and the holder 13. The base body 16*a* is made of, for example, a resin material, etc. The base body 16*a* has a plate-like portion facing the flow passage member 1 described above. This plate-like portion has a plurality of holes 16*d* into which the connection pipes 11*a*, 11*b*, 11*c*, and 11*d* described above are inserted. The base body 16*a* has a portion extending in the Z2 direction from this plate-like portion. A flange 16*e* for being fixed to the support 41 described earlier is provided at the end of the portion extending in the Z2 direction.

The congregated board 16*b* is a mount component for electric connection between the control unit 20 and the wiring board 12 described earlier. The congregated board 16*b* is, for example, a rigid wiring board. The cover 16*c* is a plate-like member for protecting the congregated board 16*b* and fixing the congregated board 16*b* to the base body 16*a*. The cover 16*c* is made of, for example, a resin material, etc., and is fastened to the base body 16*a* by screws, etc.

1-4. Head Body 14

Figure 4:
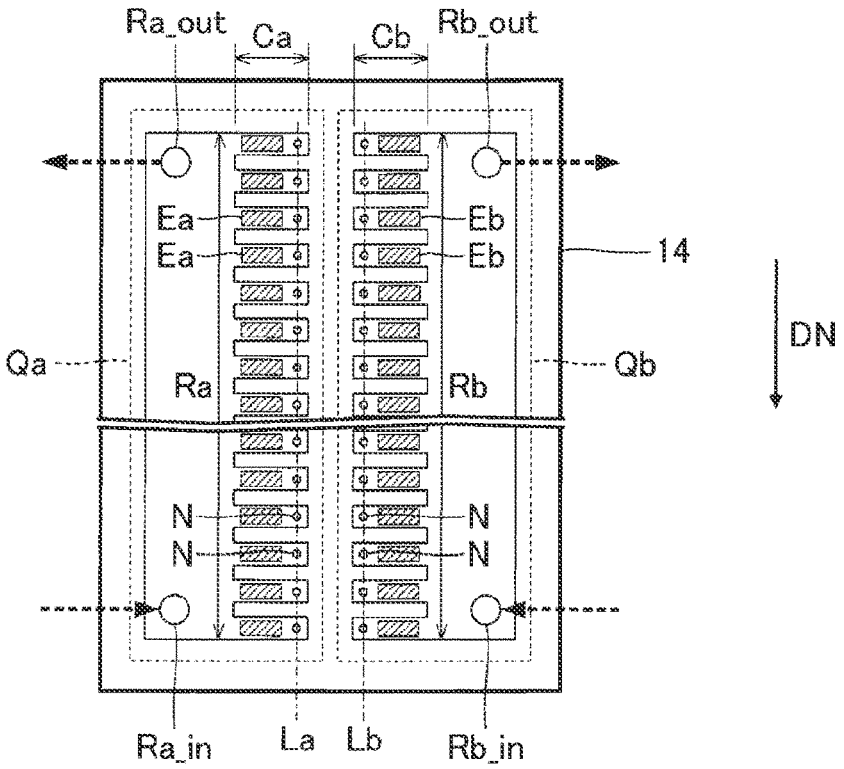
FIG. 4 is a plan view of a head body of the liquid ejecting head.

FIG. 4 is a plan view of the head body 14 of the liquid ejecting head 10. In FIG. 4, the internal structure of the head body 14 as viewed in the Z1 direction is schematically illustrated. As illustrated in FIG. 4, the head body 14 includes a liquid ejecting section Qa and a liquid ejecting section Qb. The liquid ejecting section Qa includes a nozzle row La that is made up of a plurality of nozzles N configured to eject the first ink supplied from the circulation mechanism 50 described earlier. The liquid ejecting section Qb includes a nozzle row Lb that is made up of a plurality of nozzles N configured to eject the second ink supplied from the circulation mechanism 50. The nozzles N belonging to the nozzle row La are arranged in a direction DN. The nozzles N belonging to the nozzle row Lb are also arranged in the direction DN.

The liquid ejecting section Qa includes a liquid reservoir Ra, a plurality of pressure compartments Ca, and a plurality of drive elements Ea. The liquid reservoir Ra is a common liquid chamber that is continuous throughout the plurality of nozzles N belonging to the nozzle row La. Each of the plurality of pressure compartments Ca is provided individually for the corresponding one of the plurality of nozzles N belonging to the nozzle row La. Each of the plurality of drive elements Ea is also provided individually for the corresponding one of the plurality of nozzles N belonging to the nozzle row La. The pressure compartment Ca is a space that is in communication with the nozzle N. To each of the plurality of pressure compartments Ca, the first ink is supplied from the liquid reservoir Ra to fill its space. The drive element Ea changes the pressure of the first ink inside the pressure compartment Ca. The drive element Ea is, for example, a piezoelectric element that changes the capacity of the pressure compartment Ca by deforming a wall surface of the pressure compartment Ca, or a heat generation element that produces air bubbles inside the pressure compartment Ca by heating the first ink inside the pressure compartment Ca. As a result of causing changes in the pressure of the first ink inside the pressure compartment Ca by the drive element Ea, the first ink contained inside the pressure compartment Ca is ejected from the nozzle N.

Similarly to the liquid ejecting section Qa, the liquid ejecting section Qb includes a liquid reservoir Rb, a plurality of pressure compartments Cb, and a plurality of drive elements Eb. The liquid reservoir Rb is a common liquid chamber that is continuous throughout the plurality of nozzles N belonging to the nozzle row Lb. Each of the plurality of pressure compartments Cb is provided individually for the corresponding one of the plurality of nozzles N belonging to the nozzle row Lb. Each of the plurality of drive elements Eb is also provided individually for the corresponding one of the plurality of nozzles N belonging to the nozzle row Lb. To each of the plurality of pressure compartments Cb, the second ink is supplied from the liquid reservoir Rb to fill its space. The drive element Eb is, for example, a piezoelectric element or a heat generation element mentioned above. As a result of causing changes in the pressure of the second ink inside the pressure compartment Cb by the drive element Eb, the second ink contained inside the pressure compartment Cb is ejected from the nozzle N.

As illustrated in FIG. 4, an inlet Ra_in, an outlet Ra_out, an inlet Rb_in, and an outlet Rb_out are provided in the head body 14. Each of the inlet Ra_in and the outlet Ra_out is in communication with the liquid reservoir Ra. Each of the inlet Rb_in and the outlet Rb_out is in communication with the liquid reservoir Rb.

In the head body 14 described above, the first ink that remains in the liquid reservoir Ra without being ejected from the nozzles N belonging to the nozzle row La circulates by flowing through the outlet Ra_out, the circulation flow passage for the first ink in the holder 13, the discharge flow passage for the first ink in the flow passage structure body 11, the sub tank for the first ink in the circulation mechanism 50, the supply flow passage for the first ink in the flow passage structure body 11, the supply flow passage for the first ink in the holder 13, the inlet Ra_in, and the liquid reservoir Ra in this order. Similarly, the second ink that remains in the liquid reservoir Rb without being ejected from the nozzles N belonging to the nozzle row Lb circulates by flowing through the outlet Rb_out, the circulation flow passage for the second ink in the holder 13, the discharge flow passage for the second ink in the flow passage structure body 11, the sub tank for the second ink in the circulation mechanism 50, the supply flow passage for the second ink in the flow passage structure body 11, the supply flow passage for the second ink in the holder 13, the inlet Rb_in, and the liquid reservoir Rb in this order.

Figure 5:
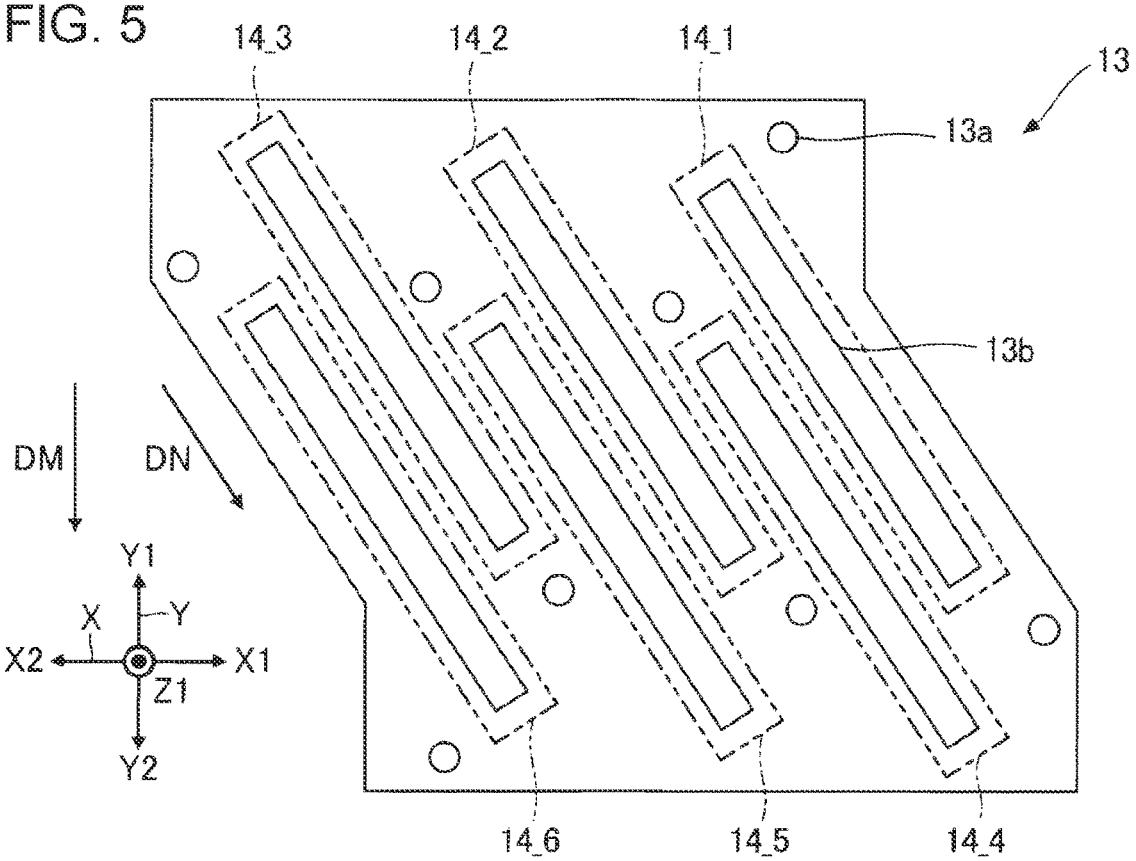
FIG. 5 is a plan view of a holder.

FIG. 5 is a plan view of the holder 13. As illustrated in FIG. 5, the holder 13 holds six head bodies 14_1 to 14_6. These head bodies are arranged in the X2 direction in the order of 14_1, 14_4, 14_2, 14_5, 14_3, 14_6. These head bodies are arranged in a staggered manner such that 14_1 to 14_3 are shifted in the Y1 direction from 14_4 to 14_6. However, the head bodies 14_1 to 14_6 have portions overlapping with one another as viewed in the X1 direction or the X2 direction. In addition, the head bodies 14_1 to 14_6 are arranged such that the linear array direction DN of the nozzle row La and the linear array direction DN of the nozzle row Lb are parallel to each other. However, each of the head bodies 14_1 to 14_6 is arranged such that the direction DN is inclined with respect to the direction DM, which is the transportation direction of the medium 101.

1-5. Flow Passage Member 1

Figure 6:
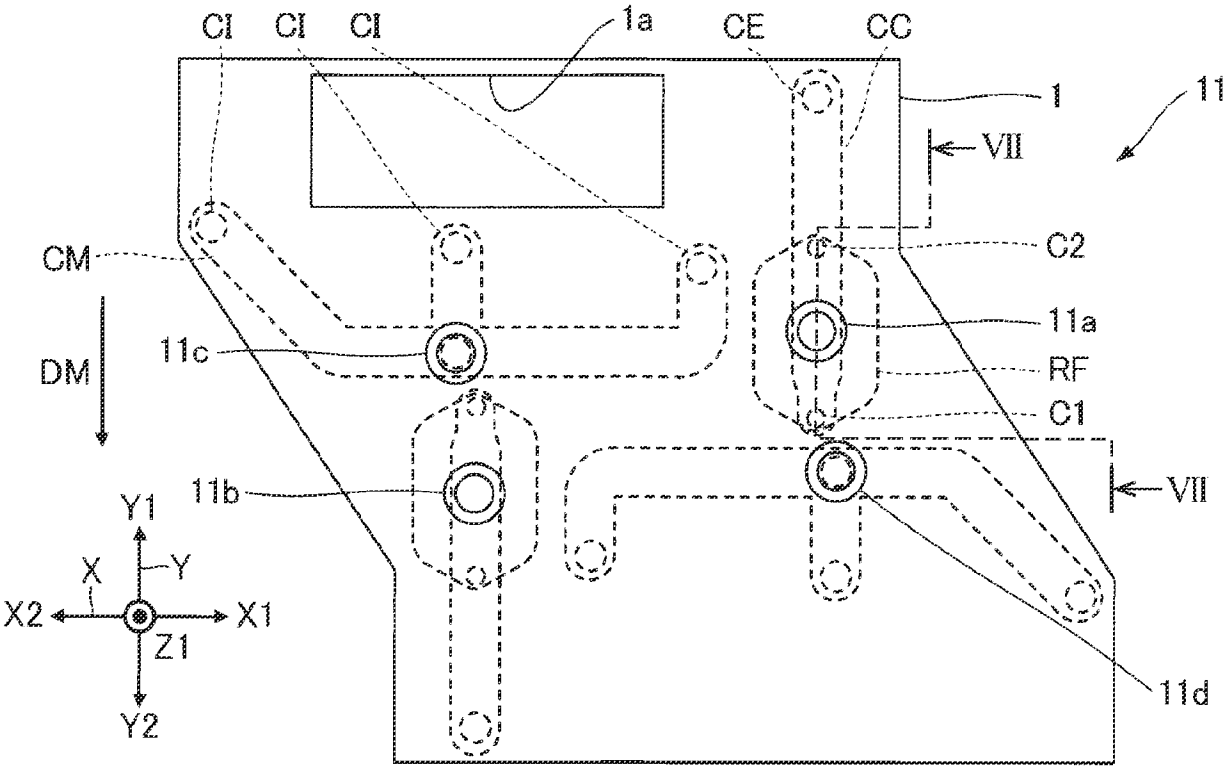
FIG. 6 is a plan view of a flow passage structure body.

FIG. 6 is a plan view of the flow passage structure body 11. In FIG. 6, an example of the internal structure of the flow passage member 1 as viewed in the Z2 direction is illustrated by broken lines. As illustrated in FIG. 6, two common flow passages CC, two discharge flow passages CM, and two filter chambers RF are provided inside the flow passage member 1. Each of the two common flow passages CC is an example of "a common flow passage".

One of the two common flow passages CC is a flow passage for supplying ink from the connection pipe 11*a* to the liquid reservoir Ra of each of the plurality of head bodies 14. The other of the two common flow passages CC is a flow passage for supplying ink from the connection pipe 11*b* to the liquid reservoir Rb of each of the plurality of head bodies 14. For each of the two common flow passages CC, an outlet CE, through which ink goes out toward the head bodies 14, is provided in communication with the common flow passage CC. The common flow passage CC is in communication with the internal space of the connection pipe 11*a* or 11*b* via the filter chamber RF. The filter chamber RF is a space inside which a filter 25 described later is provided. The filter chamber RF is in communication with the common flow passage CC via a first flow passage C1 and a second flow passage C2.

One of the two discharge flow passages CM is a flow passage for discharging ink from the liquid reservoir Ra of each of the plurality of head bodies 14 to the connection pipe 11*c*. The other of the two discharge flow passages CM is a flow passage for discharging ink from the liquid reservoir Rb of each of the plurality of head bodies 14 to the connection pipe 11*d*. For each of the two discharge flow passages CM, an inlet CI, through which ink coming from the head bodies 14 enters, is provided in communication with the discharge flow passage CM.

Figure 7:
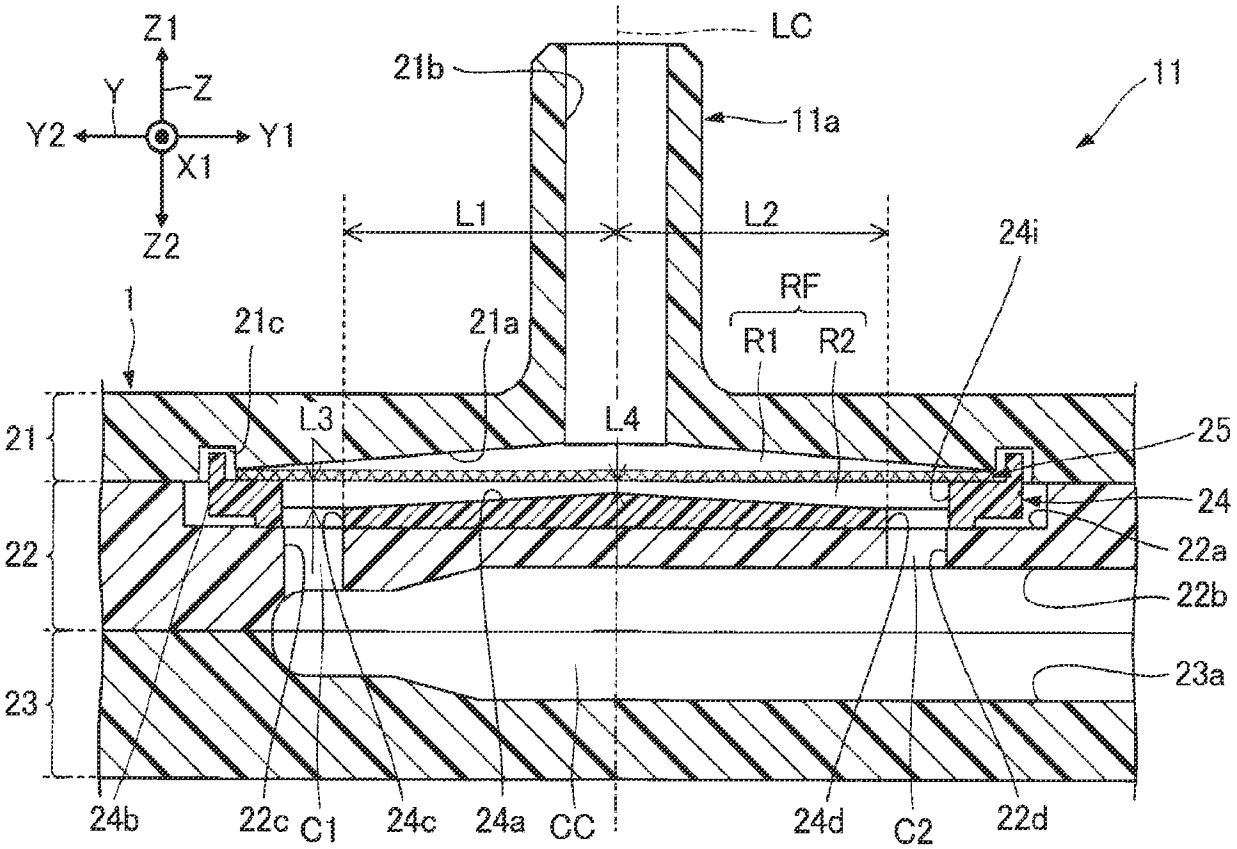
FIG. 7 is a sectional view taken along the line VII-VII of FIG. 6.
Figure 8:
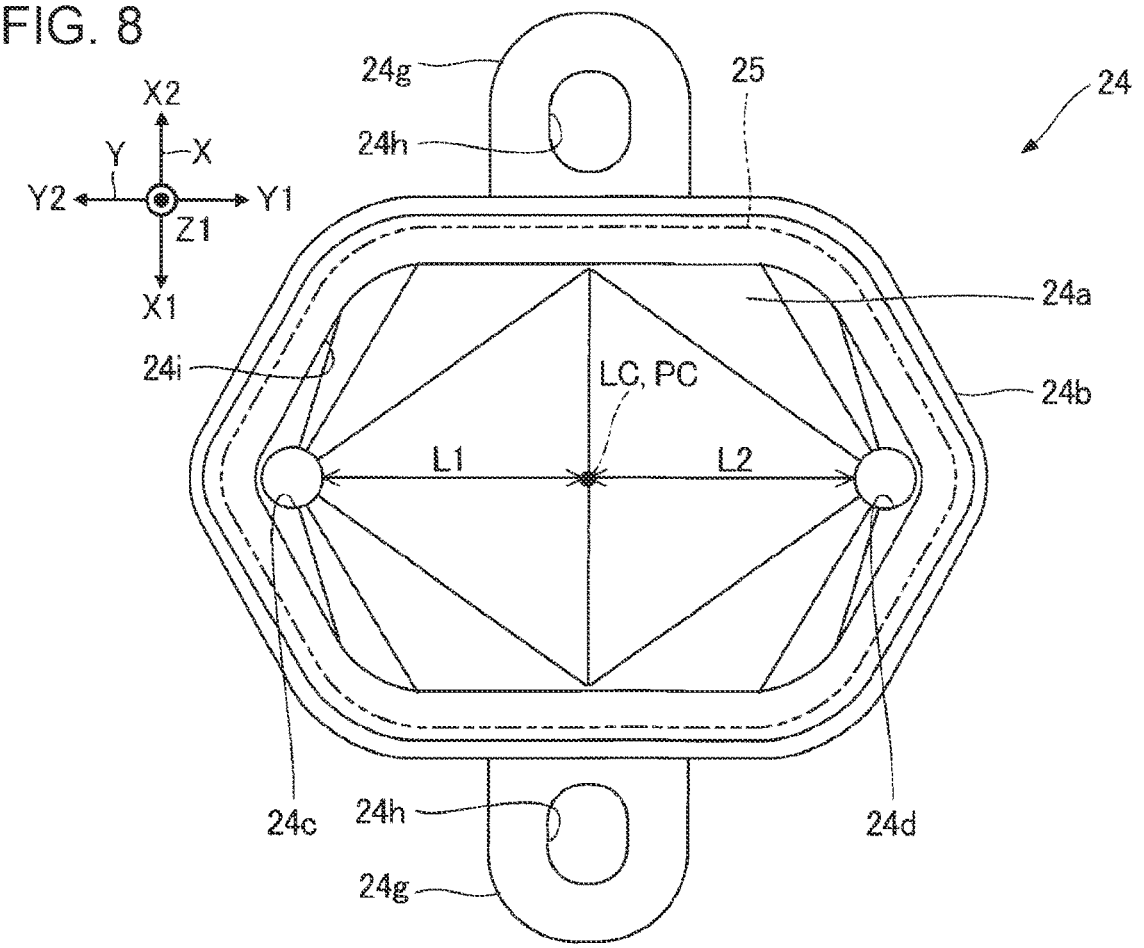
FIG. 8 is a plan view for explaining a downstream chamber, a first outlet, and a second outlet.

FIG. 7 is a sectional view taken along the line VII-VII of FIG. 6. FIG. 8 is a plan view for explaining a downstream chamber R2, a first outlet 24*c*, and a second outlet 24*d*. In FIG. 7, regarding the flow passage member 1, a structure corresponding to the connection pipe 11*a* is illustrated as a representative example. A structure corresponding to the connection pipe 11*b* is the same as the structure corresponding to the connection pipe 11*a*.

As illustrated in FIG. 7, the flow passage member 1 includes a stack of layers 21, 22, and 23 in this order as viewed toward Z2.

A recessed surface 21*a*, an inlet 21*b*, and a groove 21*c* are provided in the layer 21. The recessed surface 21*a* is provided in the surface, of the layer 21, facing in the Z2 direction. The recessed surface 21*a* constitutes a part of the wall surface of the filter chamber RF. In the example illustrated in FIG. 7, the recessed surface 21*a* has a sloped surface shape whose depth increases gradually toward the inlet 21*b*. The inlet 21*b* is a through hole that is open to the recessed surface 21*a* and is in communication with the internal space of the connection pipe 11*a*. In the example illustrated in FIG. 7, the connection pipe 11*a* and the layer 21 are configured integrally. Therefore, the connection pipe 11*a* is made of a resin material, similarly to the layer 21. The groove 21*c* is provided in the surface, of the layer 21, facing in the Z2 direction, along and outside the circumference of the recessed surface 21*a*. The groove 21*c* constitutes a space that accommodates a part of a fixing member 24, which will be described later. As another function, the groove 21*c* is able to serve as a space where an adhesive can escape.

The connection pipe 11*a* may be a separate part that is not integral with the layer 21. In this case, the connection pipe 11*a* may be made of metal, etc. The connection pipe 11*a*, in this case, is fixed to the layer 21 with an adhesive, etc. The groove 21*c* is not indispensable. If unnecessary, the groove 21*c* may be omitted. Similarly to the connection pipe 11*a*, the connection pipes 11*b* to 11*d* may be formed integrally with the layer 21 or separately from the layer 21.

A recess 22*a*, a groove 22*b*, a hole 22*c*, and a hole 22*d* are provided in the layer 22. The recess 22*a* is provided in the surface, of the layer 22, facing in the Z1 direction. The recess 22*a* constitutes a space that accommodates a part of the fixing member 24, which will be described later. The groove 22*b* is provided in the surface, of the layer 22, facing in the Z2 direction. The groove 22*b* constitutes a part of the common flow passage CC. In the example illustrated in FIGS. 6 and 7, the common flow passage CC extends along the Y axis and has a shape that includes a portion whose area size on an X-Z plane becomes narrower toward Y2. Therefore, the groove 22*b* has a shape that extends along the Y axis. Each of the holes 22*c* and 22*d* is a through hole that is open to the recess 22*a* and the groove 22*b* and goes through the layer 22. In the example illustrated in FIG. 7, the hole 22*c* is connected to the Y2-directional end of the groove 22*b*. The hole 22*d* is connected to the groove 22*b* at the Y1-directional position that is the opposite of the hole 22*c*.

A groove 23*a* is provided in the layer 23. The groove 23*a* is provided in the surface, of the layer 23, facing in the Z1 direction. The groove 23*a* constitutes a part of the common flow passage CC. In the example illustrated in FIG. 7, the groove 23*a* has a shape that extends along the Y axis. In the example illustrated in FIG. 7, the groove 22*b* of the layer 22 and the groove 23*a* of the layer 23 make up the common flow passage CC. However, the common flow passage CC may consist of one of the grooves 22*b* and 23*a*.

As illustrated in FIG. 7, in addition to the layers 21, 22, and 23 described above, the flow passage member 1 includes the fixing member 24 and the filter 25, which are provided between the layer 21 and the layer 22.

The fixing member 24 is a substantially-plate-like member that fixes the filter 25 to at least one of the layers 21 and 22 and constitutes a part of the wall surface of the filter chamber RF. In the example illustrated in FIG. 7, the fixing member 24 is provided in the recess 22*a* mentioned above. The fixing member 24 is, for example, made of a resin material and is formed by injection molding. It is possible to fix the filter 25 to the fixing member 24 by forming the fixing member 24 by insert molding with insertion of the filter 25. In addition, the fixing member 24 is fixed to at least one of the layers 21 and 22 with an adhesive, for example.

As described above, the filter 25 is fixed to at least one of the layers 21 and 22 by means of the fixing member 24. As compared with a structure in which the filter 25 is fixed to at least one of the layers 21 and 22 directly, this structure makes it possible to increase the freedom of choices in the material of the layer 21 and the material of the layer 22, and, in addition, makes it possible to reduce a risk of unintended sticking of the adhesive to the filter 25. The material of the fixing member 24 may be the same as the material of the layer 21 or 22 or different therefrom.

A bottom wall 24*a*, a frame portion 24*b*, the first outlet 24*c*, and the second outlet 24*d* are provided in the fixing member 24.

The bottom wall 24*a* is provided in the surface, of the fixing member 24, facing in the Z1 direction. The bottom wall 24*a* constitutes a part of the wall surface of the filter chamber RF. In the example illustrated in FIG. 7, the bottom wall 24*a* has a sloped shape whose depth increases gradually toward each of the first outlet 24*c* and the second outlet 24*d*. The frame portion 24*b* is a loop-shaped wall portion formed along the contour of the bottom wall 24*a*. The frame portion 24*b* constitutes the sidewall of the filter chamber RF. More specifically, a part of the inner surface of the frame portion 24*b* constitutes the sidewall 24*i* of a downstream chamber R2. In the example illustrated in FIG. 7, a part of the frame portion 24*b* is inserted into the groove 21*c* mentioned above. The fixing member 24 is positioned with respect to the layer 21 as a result of this insertion. A clearance is formed between the outer surface of the frame portion 24*b* and the wall of the recess 22*a*. The clearance is able to serve as a space where an adhesive can escape. Each of the first outlet 24*c* and the second outlet 24*d* is a through hole that is open to the bottom wall 24*a* and goes through the fixing member 24. The first outlet 24*c* is connected to the hole 22*c* mentioned above. The first outlet 24*c* and the hole 22*c* constitute the first flow passage C1. The second outlet 24*d* is connected to the hole 22*d* mentioned above. The second outlet 24*d* and the hole 22*d* constitute the second flow passage C2.

As illustrated in FIG. 8, the fixing member 24 has flanges 24*g* protruding from the frame portion 24*b* away from the center line LC. The flanges 24*g* have holes 24*h* respectively for positioning with respect to the layer 22. On its surface facing in the Z1 direction, the layer 22 has protrusions that are inserted into the holes 24*h* respectively, though not illustrated. The center line LC is a straight line that goes through the center PC and is parallel to the Z axis. The center PC is the geometric center of the downstream chamber R2 in plan view. The flanges 24*g* are not indispensable. If unnecessary, the flanges 24*g* may be omitted.

The filter 25 is a plate-type or sheet-type member that catches a foreign object, etc. contained in ink while allowing the ink to pass through itself. The filter 25 is, for example, made of metal fibers having a twilled dutch weave pattern or a plain dutch weave pattern, etc. The material of the filter 25 is not limited to metal fibers. For example, resin fibers such as nonwoven fabric may be used. Typically, the filter 25 is disposed in parallel with the nozzle face FN. However, the filter 25 may be inclined with respect to the nozzle face FN within an angular range from 0° inclusive to 45° inclusive.

The filter 25 is fixed to the frame portion 24*b* of the fixing member 24 described above. As indicated by the two-dot chain line in FIG. 8, the filter 25 is provided at an area that encompasses the entire area of the bottom wall 24*a*. Therefore, as illustrated in FIG. 7, the filter chamber RF is partitioned by the filter 25 into an upstream chamber R1 and a downstream chamber R2. The upstream chamber R1 is a space that is located over the filter 25 in the Z1 direction. The recessed surface 21*a* constitutes a part of the wall surface of this upper space. The downstream chamber R2 is a space that is located under the filter 25 in the Z2 direction. The sidewall 24*i* and the bottom wall 24*a* constitute a part of the wall surface of this lower space.

As described above, the liquid ejecting head 10 includes the nozzle face FN, the filter 25, the downstream chamber R2, the first flow passage C1, the second flow passage C2, and the common flow passage CC, which is an example of "a common flow passage". As described earlier, the nozzle face FN has the plurality of nozzles N from which ink as an example of liquid is ejected. Ink flows to pass through the filter 25. The downstream chamber R2 includes the first outlet 24*c* and the second outlet 24*d* for discharging ink. The downstream chamber R2 is located downstream of the filter 25. The filter 25 constitutes a part of the wall surface of the downstream chamber R2. The first flow passage C1 is in communication with the downstream chamber R2 through the first outlet 24*c*. The second flow passage C2 is in communication with the downstream chamber R2 through the second outlet 24*d*. The common flow passage CC is in communication with the first flow passage C1 and the second flow passage C2.

The liquid ejecting module 40 is sometimes installed in an inclined orientation such that the nozzle face FN is inclined with respect to a horizontal plane SF due to rotational inclination around the X axis extending in the length direction of the liquid ejecting module 40, which is a line head. In the present embodiment, as illustrated in FIG. 8, in plan view perpendicular to the nozzle face FN, the first outlet 24*c* is located at a position that is shifted from the center PC of the downstream chamber R2 in the Y2 direction, and the second outlet 24*d* is located at a position that is shifted from the center PC of the downstream chamber R2 in the Y1 direction. Therefore, even if the nozzle face FN is inclined with respect to the horizontal plane SF around an axis parallel to the X axis, it is possible to cause air bubbles formed inside the downstream chamber R2 to exit through the first outlet 24*c* or the second outlet 24*d*.

Figure 9:
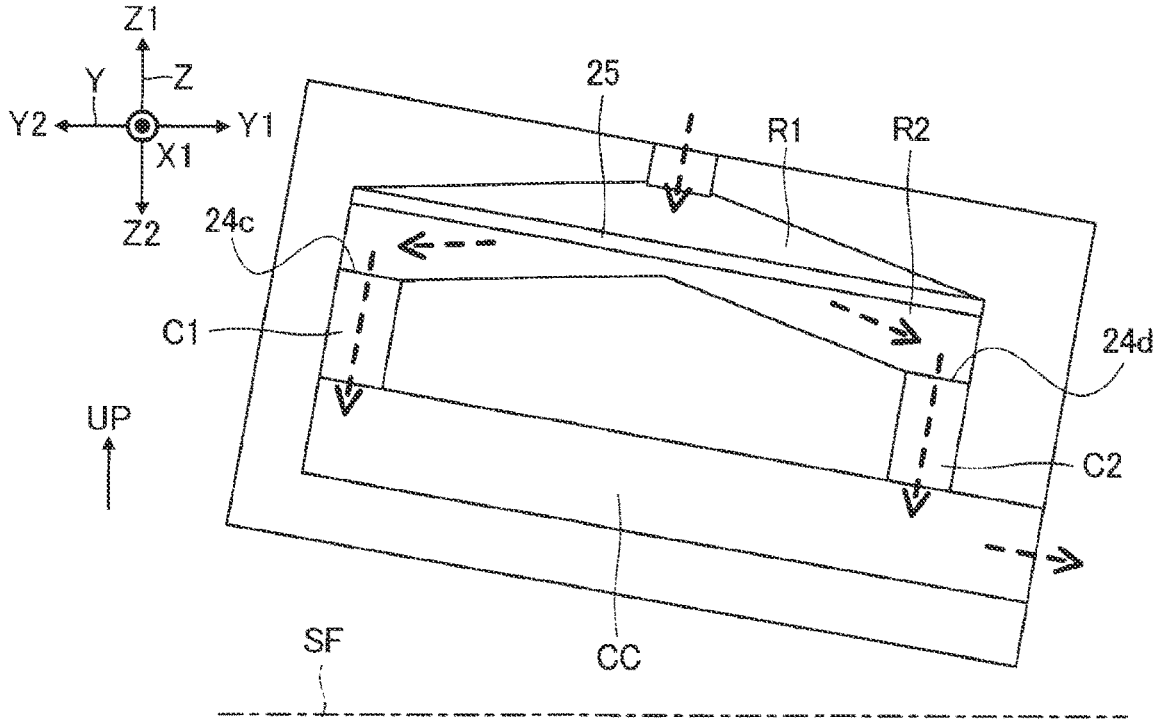
FIG. 9 is a schematic view for explaining the operational function of the first outlet and the second outlet.

FIG. 9 is a schematic view for explaining the operational function of the first outlet 24*c* and the second outlet 24*d*. For example, as illustrated in FIG. 9, when the first outlet 24*c* is located above the second outlet 24*d* due to the inclination, air bubbles formed inside the downstream chamber R2 rise up inside the downstream chamber R2 due to buoyancy. Then, the air bubbles are discharged through the first outlet 24*c*, which is located at the upper position in this case. Similarly, when the first outlet 24*c* is located below the second outlet 24*d* due to the inclination, air bubbles formed inside the downstream chamber R2 rise up inside the downstream chamber R2 due to buoyancy, and then are discharged through the second outlet 24*d*, which is located at the upper position in this case. With the above structure, it is possible to reduce the stay of air bubbles inside the downstream chamber R2 regardless of the installation orientation of the liquid ejecting head 10. Therefore, it is possible to prevent abnormal ink ejection status caused by the blocking of the mesh of the filter 25 by air bubbles.

Figure 10:
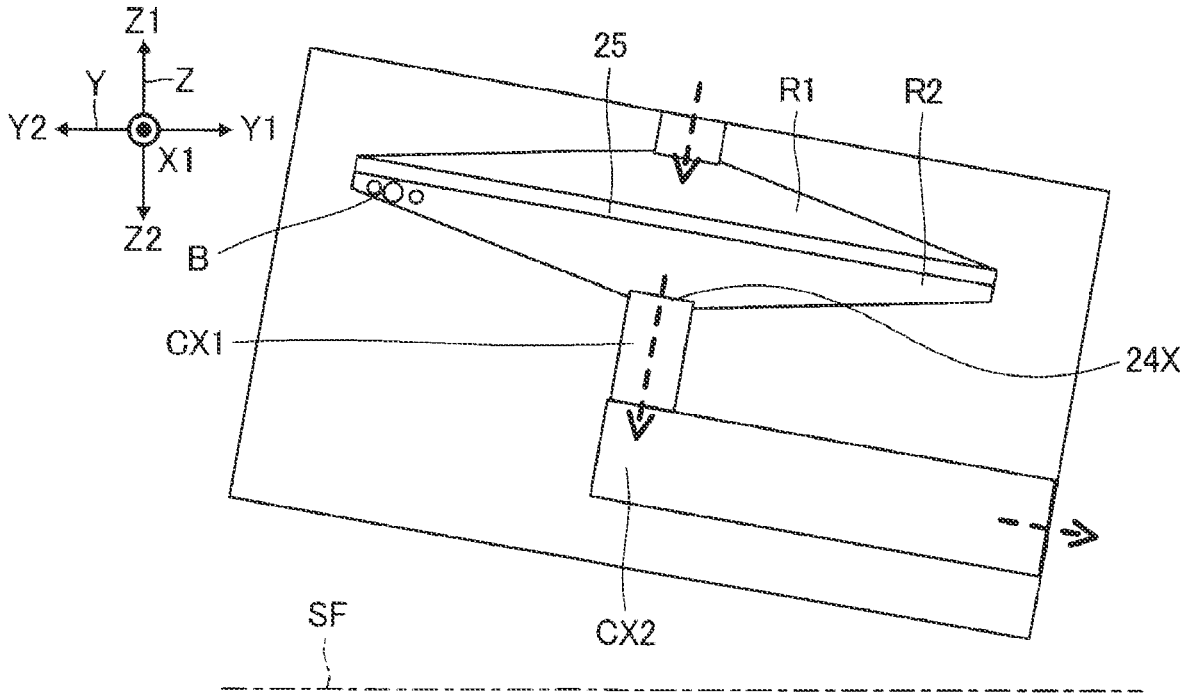
FIG. 10 is a schematic view for explaining a technical issue that needs to be solved in related art.

FIG. 10 is a schematic view for explaining a technical issue that needs to be solved in related art. As illustrated in FIG. 10, in a structure in which ink contained in the downstream chamber R2 is discharged though a single outlet 24X to a flow passage CX1 and then to a flow passage CX2, if the downstream chamber R2 is inclined with respect to the horizontal plane SF, air bubbles B that have risen due to buoyancy will stay at an upper position inside the downstream chamber R2. The air bubbles B will block a part of the mesh of the filter 25, resulting in abnormal ink ejection status. It is conceivable to form the outlet 24X at a position that is off the center of the downstream chamber R2 upward. However, forming the outlet 24X at such an off-the-center position will impose restrictions on installation orientation and, therefore, it is necessary to manufacture different heads whose positions of the outlet 24X differ depending on specific uses. This will be disadvantageous in terms of cost.

Preferably, the area size of the first outlet 24*c* and the area size of the second outlet 24*d* may be equal to each other. In this case, regardless of whether the first outlet 24*c* is located above or below the second outlet 24*d*, it is possible to make it equally easier for the air bubbles B to exit. Therefore, in a structure in which the exiting of the air bubbles B is facilitated by circulating ink or by performing maintenance operation, there is no need to make operating conditions for discharging the air bubbles different depending on the installation orientation of the downstream chamber R2. As a result, it is possible to simplify the operation of the apparatus. In this specification, the meaning of the term "equal" encompasses not only a case of exact equality but also cases of approximate equality with a tolerance of 5% or less due to a manufacturing error, etc.

In light of the same advantageous aspect, preferably, a distance L1 from the center PC of the downstream chamber R2 to the first outlet 24*c* and a distance L2 from the center PC of the downstream chamber R2 to the second outlet 24*d* may be equal to each other. In this case, regardless of whether the first outlet 24*c* is located above or below the second outlet 24*d*, it is possible to make it equally easier for the air bubbles B to exit.

In plan view, the downstream chamber R2 has a portion whose width in a direction in which the X axis extends decreases from the center PC of the downstream chamber R2 toward the first outlet 24*c*. Therefore, as compared with a structure that does not include such a narrowing portion, it is possible to make it easier for ink and air bubbles to flow from the center PC of the downstream chamber R2 toward the first outlet 24*c*. Similarly, in plan view, the downstream chamber R2 has a portion whose width in a direction in which the X axis extends decreases from the center PC of the downstream chamber R2 toward the second outlet 24*d*. Therefore, as compared with a structure that does not include such a narrowing portion, it is possible to make it easier for ink and air bubbles to flow from the center PC of the downstream chamber R2 toward the second outlet 24*d*.

In the present embodiment, the shape of the downstream chamber R2 in plan view is substantially hexagonal, and the first outlet 24*c* is located near one vertex of the hexagon. In FIG. 8, each vertex of the downstream chamber R2 having a substantially hexagonal shape is rounded. However, the vertex may have a non-rounded shape. Therefore, as described above, in plan view, the downstream chamber R2 has a portion whose width in the direction in which the X axis extends decreases from the center PC toward the first outlet 24*c* without steps. Among the six vertices of the downstream chamber R2 having a substantially hexagonal shape in plan view, the second outlet 24*d* is located near the opposite vertex, which is the opposite of the vertex near which the first outlet 24*c* is located. Therefore, in plan view, the downstream chamber R2 has a portion whose width in the direction in which the X axis extends decreases from the center PC toward the second outlet 24*d* without steps. The shape of the downstream chamber R2 in plan view is not limited to a substantially hexagonal shape. The downstream chamber R2 may have any shape in plan view. However, preferably, the downstream chamber R2 has a portion that makes it easier for ink and air bubbles to flow from the center PC of the downstream chamber R2 toward the first outlet 24*c* or the second outlet 24*d*. It is sufficient as long as the narrowing portion is provided at, at least, a part of the downstream chamber R2 between the center PC and the first outlet 24*c* or between the center PC and the second outlet 24*d*. The narrowing portion is not limited to the above-described narrowing portion whose width decreases without steps. The width of the narrowing portion may decrease stepwise.

As described earlier, the liquid ejecting head 10 includes the bottom wall 24*a* that, together with the filter 25, demarcates the downstream chamber R2, and faces the filter 25. The first outlet 24*c* is provided in the bottom wall 24*a*. Therefore, as compared with a structure in which the first outlet 24*c* is provided in a sidewall of the downstream chamber R2, it is easier to cause air bubbles to exit through the first outlet 24*c*. Moreover, as compared with a structure in which the first outlet 24*c* is provided in a sidewall of the downstream chamber R2, it is possible to make the routing of the first flow passage C1 simpler. As a result, it is easier to reduce the size of the liquid ejecting head 10, which is another advantage. In the present embodiment, in addition to the first outlet 24*c*, the second outlet 24*d* is provided in the bottom wall 24*a*. Therefore, the same effects as those described above can be obtained. Depending on conditions, etc. that the liquid ejecting head 10 is required to meet, at least one of the first outlet 24*c* and the second outlet 24*d* may be provided in a sidewall of the downstream chamber R2.

Similarly, for the purpose of making it easier for air bubbles to exit through the first outlet 24*c*, a distance L3 between the first outlet 24*c* and the filter 25 is configured to be longer than a distance L4 between the bottom wall 24*a* at the center PC of the downstream chamber R2 in plan view and the filter 25. The distance L3 is a distance between the first outlet 24*c* and the filter 25 in the direction in which the Z axis extends. The distance L4 is a distance between the bottom wall 24*a* and the filter 25 in the direction in which the Z axis extends at a position overlapping with the center PC of the downstream chamber R2 in plan view. In the present embodiment, the bottom wall 24*a* has a sloped shape whose depth increases gradually toward the first outlet 24*c*. This structure makes it easier for ink and air bubbles to flow along the bottom wall 24*a* toward the first outlet 24*c*. In the present embodiment, similarly to the distance L3, the distance between the second outlet 24*d* and the filter 25 is also longer than the distance L4 between the bottom wall 24*a* at the center PC of the downstream chamber R2 in plan view and the filter 25. Therefore, it is easier for ink and air bubbles to flow along the bottom wall 24*a* toward the second outlet 24*d*.

The first outlet 24*c* is located at an end portion of the downstream chamber R2 in the Y2 direction. The second outlet 24*d* is located at an end portion of the downstream chamber R2 in the Y1 direction. Therefore, regardless of whether the first outlet 24*c* is located above or below the second outlet 24*d*, it is possible to make it easier for the air bubbles B to exit. In the above description, "an end portion of the downstream chamber R2 in the Y2 direction" means a portion located at a position closer to the end of the downstream chamber R2 in the Y2 direction than the center line LC of the downstream chamber R2. In addition, it can be said that the first outlet 24*c* is located at an end portion of the downstream chamber R2 in the Y2 direction when the distance between the first outlet 24*c* and the sidewall of the downstream chamber R2 is less than the diameter of the first outlet 24*c*. Similarly, "an end portion of the downstream chamber R2 in the Y1 direction" means a portion located at a position closer to the end of the downstream chamber R2 in the Y1 direction than the center line LC of the downstream chamber R2. In addition, it can be said that the second outlet 24*d* is located at an end portion of the downstream chamber R2 in the Y1 direction when the distance between the second outlet 24*d* and the sidewall of the downstream chamber R2 is less than the diameter of the second outlet 24*d*.

The liquid ejecting apparatus 100 includes the upstream chamber R1. The upstream chamber R1 includes the inlet 21*b* through which ink flows in. The upstream chamber R1 is located upstream of the filter 25. The filter 25 constitutes a part of the wall surface of the upstream chamber R1. The inlet 21*b* is located between the first outlet 24*c* and the second outlet 24*d* in plan view. Therefore, as compared with a structure in which the inlet 21*b* is not located between the first outlet 24*c* and the second outlet 24*d* in plan view, it is possible to make it easier with greater equality for the air bubbles B to exit, regardless of whether the first outlet 24*c* is located above or below the second outlet 24*d*. In the present embodiment, the inlet 21*b* is located at the center between the first outlet 24*c* and the second outlet 24*d* in plan view. Because of this structure, it is easier to equalize the ease of the exiting of the air bubbles B between a case where the first outlet 24*c* is located above the second outlet 24*d* and a case where the first outlet 24*c* is located below the second outlet 24*d*. In the present embodiment, the center where the inlet 21*b* is located between the first outlet 24*c* and the second outlet 24*d* in plan view is on the center line LC of the downstream chamber R2 and agrees with the center of the upstream chamber R1.

2. Second Embodiment

A second embodiment of the present disclosure will now be explained. In the exemplary embodiment described below, the same reference numerals as those used in the description of the first embodiment are assigned to elements that are the same in operation and/or function as those in the first embodiment, and a detailed explanation of them is omitted.

Figure 11:
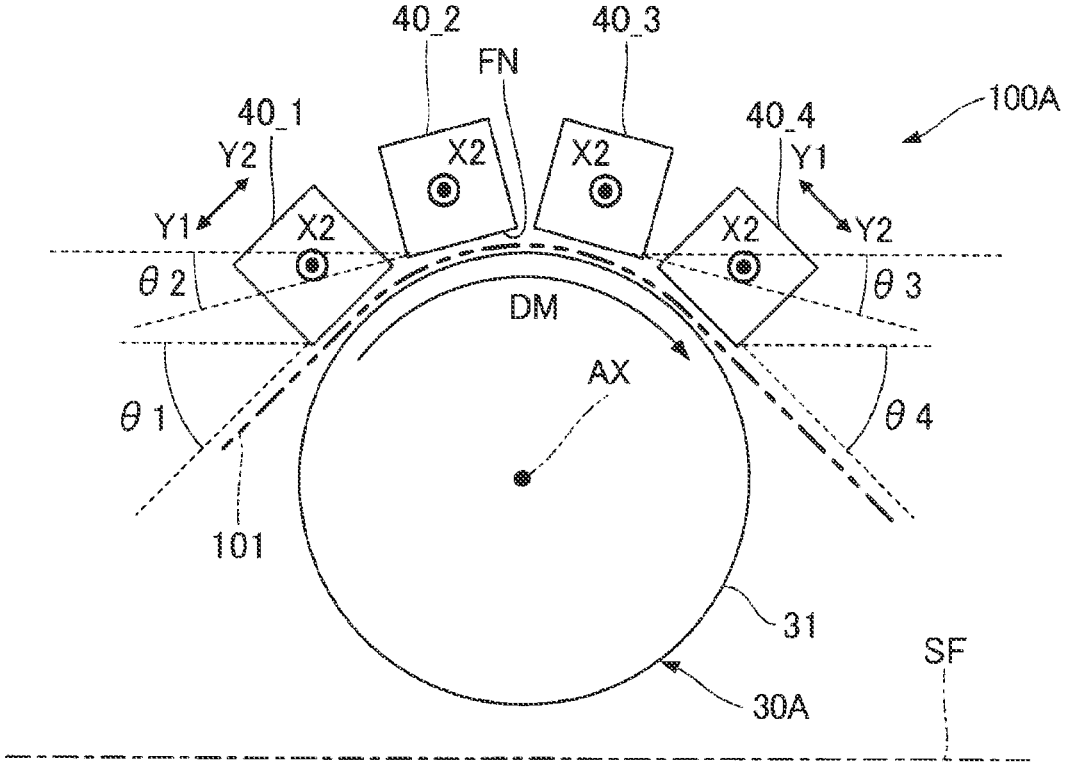
FIG. 11 is a schematic diagram of a liquid ejecting apparatus according to a second embodiment.

FIG. 11 is a schematic diagram of a liquid ejecting apparatus 100A according to a second embodiment. The liquid ejecting apparatus 100A is the same as the liquid ejecting apparatus 100 according to the foregoing first embodiment except that the liquid ejecting apparatus 100A includes a transport mechanism 30A in place of the transport mechanism 30 and includes a plurality of liquid ejecting modules 40. In FIG. 11, the control unit 20 and the circulation mechanism 50, etc. are not illustrated.

As illustrated in FIG. 11, the transport mechanism 30A includes a drum 31 that transports the medium 101 in a state in which the medium 101 is adsorbed on its circumferential surface. The drum 31 is a cylindrical or columnar member that has the circumferential surface whose center is on a center axis AX that is in parallel with the X axis. The drum 31 rotates around the center axis AX when driven by a driving mechanism such as a motor that is not illustrated. The circumferential surface of the drum 31 is charged by a charger that is not illustrated. The medium 101 is electrostatically adsorbed onto the circumferential surface of the drum 31 by means of an electrostatic force produced by charging.

The structure of the transport mechanism 30A is not limited to the illustrated example. For example, a belt may be used in place of the drum 31. Air suction may be used in place of electrostatic adsorption. The transport mechanism 30A may include other components, for example, a static eliminator, in addition to the components described above.

Each of liquid ejecting modules 40_1, 40_2, 40_3, and 40_4 faces the circumferential surface of the drum 31. Each of the liquid ejecting modules 40_1, 40_2, 40_3, and 40_4 has the same structure as that of the liquid ejecting module 40 according to the foregoing first embodiment. That is, in each of the liquid ejecting modules 40_1, 40_2, 40_3, and 40_4, in plan view perpendicular to the nozzle face FN, the first outlet 24*c* is located at a position that is shifted from the center PC of the downstream chamber R2 in the Y2 direction, and the second outlet 24*d* is located at a position that is shifted from the center PC of the downstream chamber R2 in the Y1 direction.

However, the orientations of the liquid ejecting modules 40_1, 40_2, 40_3, and 40_4 around the axis that is in parallel with the X axis are different from one another. The types of ink used for the liquid ejecting modules 40_1, 40_2, 40_3, and 40_4 may be different from one another. For example, the colors of ink used for the liquid ejecting modules 40_1, 40_2, 40_3, and 40_4 may be different from one another. In this case, for example, four colors of ink such as yellow, magenta, cyan, and black may be used.

More specifically, the liquid ejecting modules 40_1, 40_2, 40_3, and 40_4 are arranged in this order in a direction DM along the circumferential surface of the drum 31. In addition, the liquid ejecting modules 40_1, 40_2, 40_3, and 40_4 are arranged in such a manner that the nozzle face FN of each of them is in parallel with a plane tangential to the circumferential surface of the drum 31 due to their rotational layout around the rotational shaft extending in the X1 direction, which is the length direction of the liquid ejecting module 40.

The angle of inclination θ1 of the nozzle face FN of the liquid ejecting module 40_1 with respect to the horizontal plane SF is equal to the angle of inclination θ4 of the nozzle face FN of the liquid ejecting module 40_4 with respect to the horizontal plane SF. However, the nozzle face FN of the liquid ejecting module 40_1 is inclined upward in the vertical direction from upstream to downstream in the transportation direction of the medium 101 over the drum 31. On the other hand, the nozzle face FN of the liquid ejecting module 40_4 is inclined downward in the vertical direction from upstream to downstream in the transportation direction of the medium 101 over the drum 31.

Similarly, the angle of inclination θ2 of the nozzle face FN of the liquid ejecting module 40_2 with respect to the horizontal plane SF is equal to the angle of inclination θ3 of the nozzle face FN of the liquid ejecting module 40_3 with respect to the horizontal plane SF. However, each of the angles of inclination θ2 and θ3 is smaller than the angle of inclination θ1 or θ4 described above. The nozzle face FN of the liquid ejecting module 40_2 is inclined upward in the vertical direction from upstream to downstream in the transportation direction of the medium 101 over the drum 31. On the other hand, the nozzle face FN of the liquid ejecting module 40_3 is inclined downward in the vertical direction from upstream to downstream in the transportation direction of the medium 101 over the drum 31.

Even when configured as in the second embodiment described above, it is possible to reduce the stay of air bubbles, similarly to the foregoing first embodiment. In the present embodiment, as has already been explained, the liquid ejecting apparatus 100A includes the liquid ejecting modules 40_1, 40_2, 40_3, and 40_4. Any one of the liquid ejecting modules 40_1, 40_2, 40_3, and 40_4 corresponds to a first line head. If the liquid ejecting module 40_1 corresponds to the first line head, the liquid ejecting module 40_4 corresponds to a second line head. If the liquid ejecting module 40_2 corresponds to the first line head, the liquid ejecting module 40_3 corresponds to the second line head. If the liquid ejecting module 40_3 corresponds to the first line head, the liquid ejecting module 40_2 corresponds to the second line head. If the liquid ejecting module 40_4 corresponds to the first line head, the liquid ejecting module 40_1 corresponds to the second line head. The second line head described above is located upstream of or downstream of the first line head on the path along which the medium 101 is transported.

For example, if the liquid ejecting module 40_1 corresponds to the first line head and further if the liquid ejecting module 40_4 corresponds to the second line head, the liquid ejecting module 40_1 is arranged with an inclination such that the end of the nozzle face FN in the Y2 direction is located above the end of the nozzle face FN in the Y1 direction. On the other hand, the liquid ejecting module 40_4 is arranged with an inclination such that the end of the nozzle face FN in the Y2 direction is located below the end of the nozzle face FN in the Y1 direction.

In other words, the liquid ejecting apparatus 100A includes the liquid ejecting module 40_1 whose nozzle face FN is inclined with respect to the horizontal plane SF due to a counterclockwise rotational tilt around the X axis as viewed in the X1 direction and the liquid ejecting module 40_4 whose nozzle face FN is inclined with respect to the horizontal plane SF due to a clockwise rotational tilt around the X axis as viewed in the X1 direction. Even when configured to include the plurality of liquid ejecting modules 40_1, 40_2, 40_3, and 40_4 arranged with clockwise and counterclockwise rotational tilts around the X axis, the disclosed structure makes it possible to reduce the stay of air bubbles inside the downstream chamber R2 because each of the liquid ejecting modules 40_1, 40_2, 40_3, and 40_4 has the first outlet 24*c* that is located at a position that is shifted from the center PC of the downstream chamber R2 in the Y2 direction orthogonal to the X-axis direction and the second outlet 24*d* that is located at a position that is shifted from the center PC of the downstream chamber R2 in the Y1 direction orthogonal to the X-axis direction and thus because either one of the first outlet 24*c* and the second outlet 24*d* is located above the other inside the downstream chamber R2. Even if a common structure is adopted for the liquid ejecting modules 40_1, 40_2, 40_3, and 40_4, it is possible to reduce the stay of air bubbles inside the downstream chamber R2 because the liquid ejecting module 40 has the first outlet 24*c* and the second outlet 24*d* described above.

The angle of inclination θ1 of the nozzle face FN of the liquid ejecting module 40_1 with respect to the horizontal plane SF and the angle of inclination θ4 of the nozzle face FN of the liquid ejecting module 40_4 with respect to the horizontal plane SF are equal to each other. Therefore, there is no need to make the operating conditions of the liquid ejecting module 40_1 for causing the air bubbles to exit and the operating conditions of the liquid ejecting module 40_1 for causing the air bubbles to exit different from each other. Regarding this advantage, a case where the liquid ejecting module 40_2 corresponds to the first line head and where the liquid ejecting module 40_3 corresponds to the second line head is the same as the above case where the liquid ejecting module 40_1 corresponds to the first line head and where the liquid ejecting module 40_4 corresponds to the second line head.

3. Third Embodiment

A third embodiment of the present disclosure will now be explained. In the exemplary embodiment described below, the same reference numerals as those used in the description of the first embodiment are assigned to elements that are the same in operation and/or function as those in the first embodiment, and a detailed explanation of them is omitted.

Figure 12:
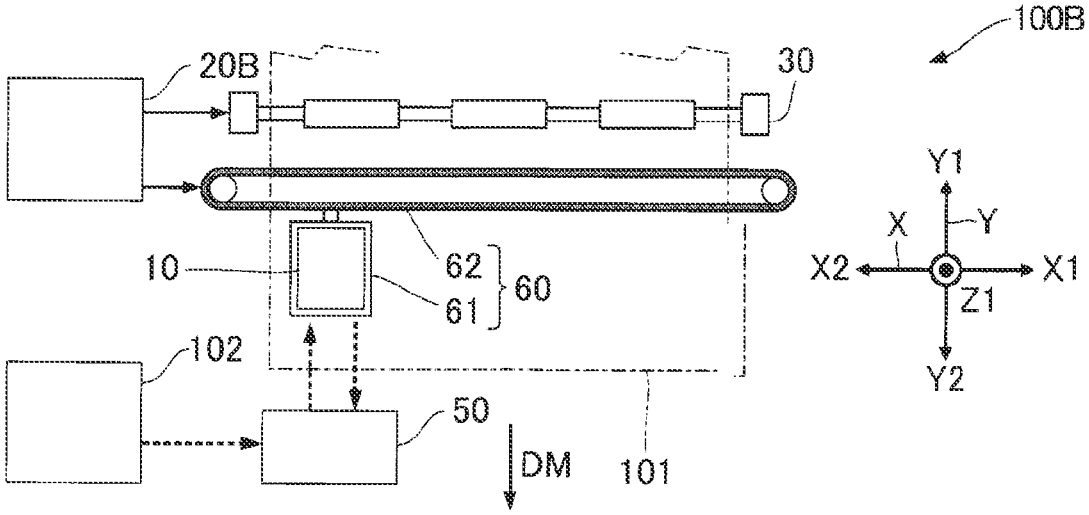
FIG. 12 is a schematic diagram of a liquid ejecting apparatus according to a third embodiment.

FIG. 12 is a schematic diagram of a liquid ejecting apparatus 100B according to a third embodiment. The liquid ejecting apparatus 100B is the same as the liquid ejecting apparatus 100 according to the foregoing first embodiment except that the liquid ejecting apparatus 100B includes a liquid ejecting module 40B in place of the liquid ejecting module 40 and includes a movement mechanism 60.

The movement mechanism 60 causes the liquid ejecting module 40B to reciprocate in the X1 direction and the X2 direction in accordance with control by the control unit 20. In the example illustrated in FIG. 12, the movement mechanism 60 includes a box-type carriage 61, which houses the liquid ejecting module 40B, and a transportation belt 62, to which the carriage 61 is fixed. Driven by power supplied from a driving source that is not illustrated, the transportation belt 62 causes the carriage 61 to reciprocate in the X1 direction and the X2 direction.

The liquid ejecting module 40B has the same structure as that of the liquid ejecting module 40 according to the foregoing first embodiment except that its nozzles are distributed throughout a part of the range of the medium 101 in the X-axis direction. That is, in the liquid ejecting module 40B, in plan view perpendicular to the nozzle face FN, the first outlet 24*c* is located at a position that is shifted from the center PC of the downstream chamber R2 in the Y2 direction, and the second outlet 24*d* is located at a position that is shifted from the center PC of the downstream chamber R2 in the Y1 direction.

In the liquid ejecting apparatus 100B described above, concurrently with the transportation of the medium 101 by the transport mechanism 30 and the reciprocation of the liquid ejecting module 40B by the movement mechanism 60, ink is ejected from the liquid ejecting module 40B. As a result of this concurrent operation, an image is formed using ink on the surface of the medium 101.

Even when configured as in the third embodiment described above, it is possible to reduce the stay of air bubbles, similarly to the foregoing first embodiment. In the present embodiment, as has already been explained, the liquid ejecting apparatus 100B includes the carriage 61. As has already been explained, the carriage 61 supporting the liquid ejecting heads 10 reciprocates along the X axis extending in the direction intersecting with the Y2 direction. In such a serial-type liquid ejecting apparatus 100B, the liquid ejecting head 10 is sometimes installed in an inclined orientation with respect to the horizontal plane around the axis parallel to the X-axis direction, in which the carriage 61 reciprocates. Therefore, either one of the first outlet 24*c* and the second outlet 24*d* is located above the other inside the downstream chamber R2. Consequently, the above-described desirable effect of reducing the stay of air bubbles will be obtained.

4. Fourth Embodiment

A fourth embodiment of the present disclosure will now be explained. In the exemplary embodiment described below, the same reference numerals as those used in the description of the first embodiment are assigned to elements that are the same in operation and/or function as those in the first embodiment, and a detailed explanation of them is omitted.

Figure 13:
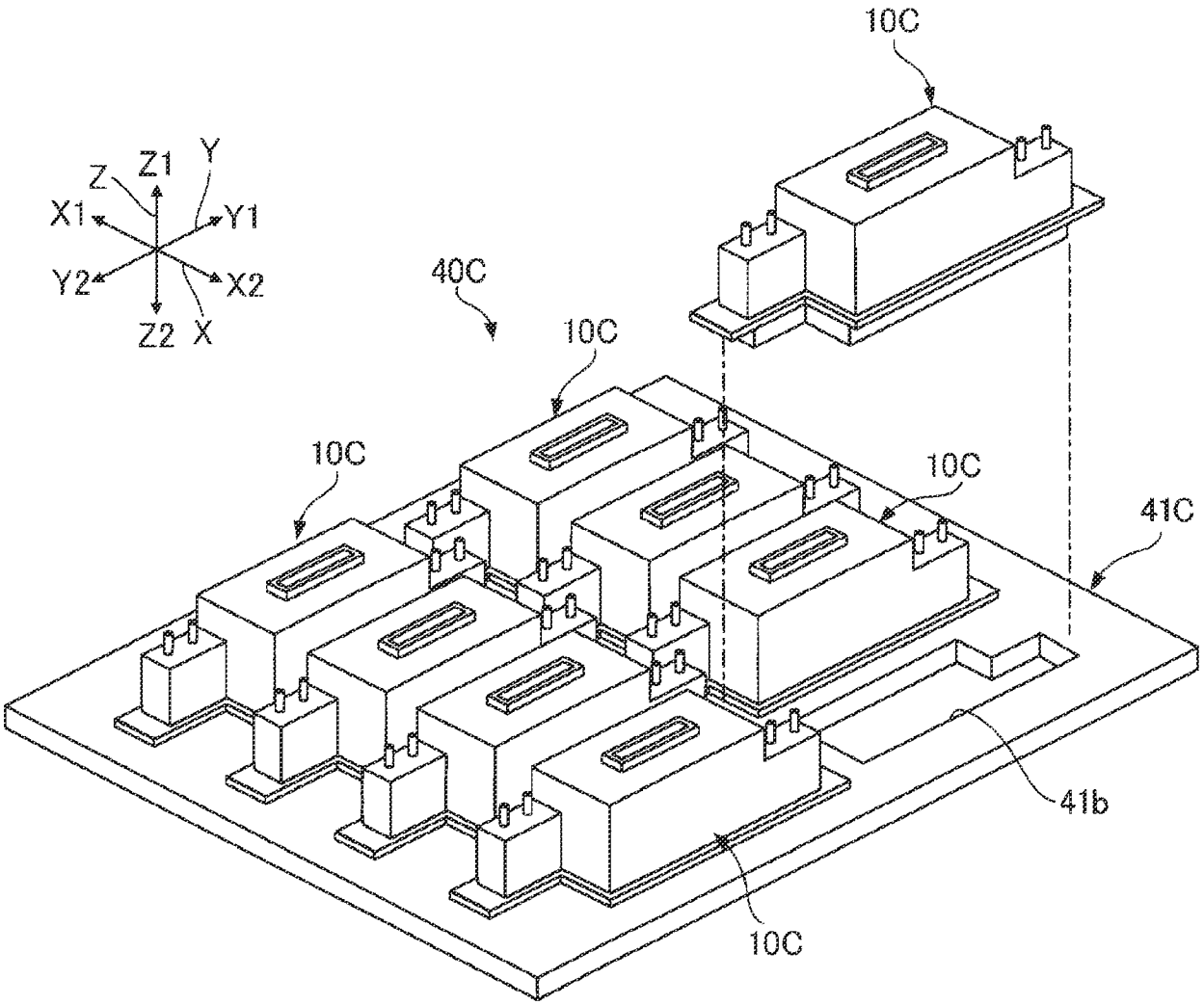
FIG. 13 is a perspective view of a liquid ejecting module that includes liquid ejecting heads according to a fourth embodiment.

FIG. 13 is a perspective view of a liquid ejecting module that includes liquid ejecting heads according to a fourth embodiment. As illustrated in FIG. 13, a liquid ejecting module 40C includes a support 41C and a plurality of liquid ejecting heads 10C. The support 41C is a member that supports the plurality of liquid ejecting heads 10C. In the example illustrated in FIG. 13, the support 41C is a plate-like member made of metal, etc. The support 41C has a plurality of mount holes 41*b* for mounting the plurality of liquid ejecting heads 10C. The liquid ejecting head 10C is inserted in each of the plurality of mount holes 41*b*. Each of the plurality of liquid ejecting heads 10C is fastened to the support 41C by screws, etc. In FIG. 13, the plural liquid ejecting heads 10C are arranged in a matrix along the X axis and the Y axis. The number of the liquid ejecting heads 10C included in the liquid ejecting module 40C is not limited to the example illustrated in FIG. 13. The liquid ejecting module 40C may include any number of the liquid ejecting heads 10C. The shape, etc. of the support 41C is also not limited to the example illustrated in FIG. 13. The support 41C may have any shape, etc.

Figure 14:
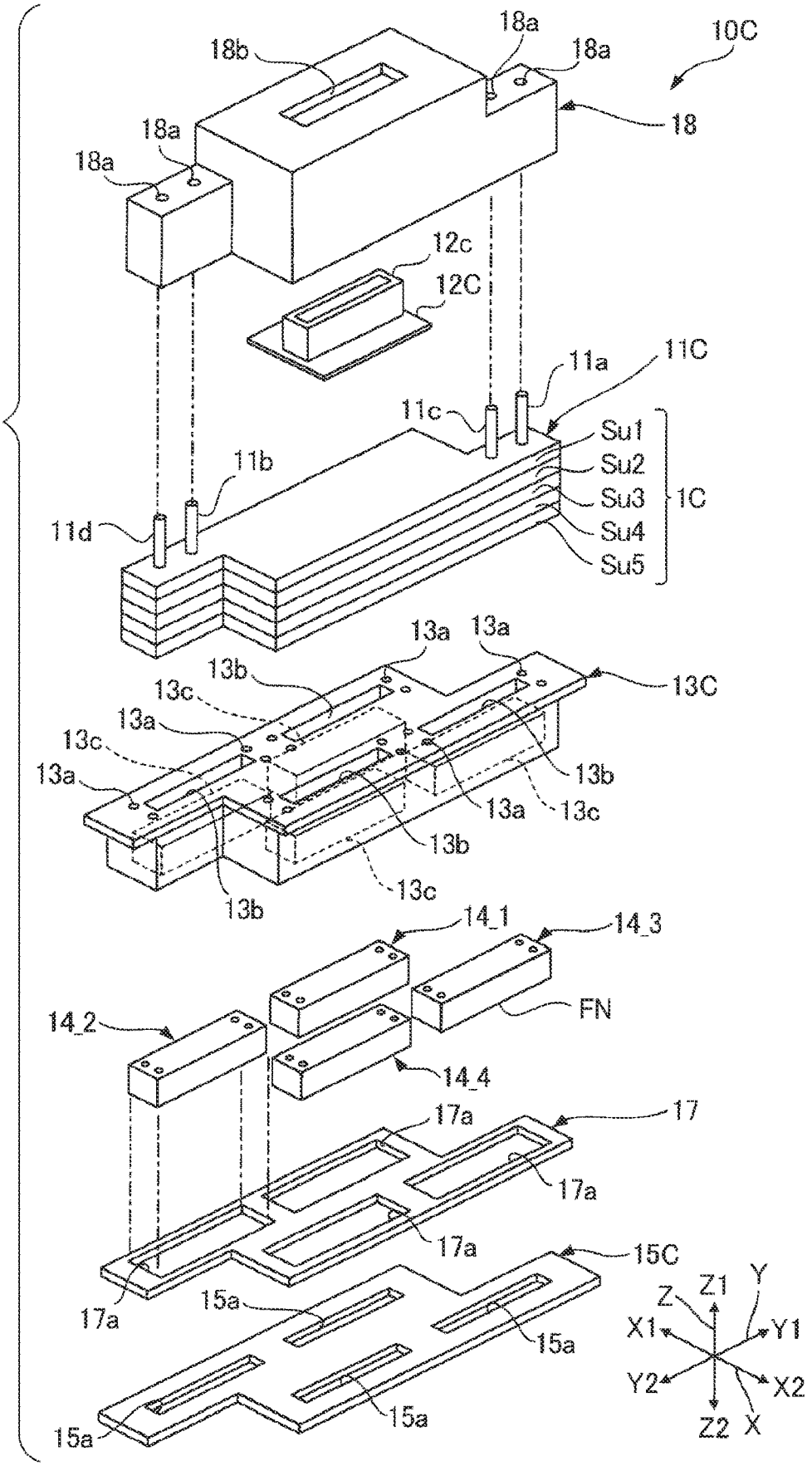
FIG. 14 is an exploded perspective view of the liquid ejecting head illustrated in FIG. 13.

FIG. 14 is an exploded perspective view of the liquid ejecting head 10C illustrated in FIG. 13. As illustrated in FIG. 14, the liquid ejecting head 10C includes a flow passage structure body 11A, a wiring board 12C, a holder 13C, head bodies 14_1, 14_2, 14_3, and 14_4, a fixing plate 15C, a reinforcing plate 17, and a cover 18. These components are disposed in the following order as viewed toward Z2: the cover 18, the wiring board 12C, the flow passage structure body 11C, the holder 13C, the head bodies 14_1, 14_2, 14_3, and 14_4, the reinforcing plate 17, and, finally, the fixing plate 15C. The components of the liquid ejecting head 10C will be described below sequentially.

The flow passage structure body 11C has the same structure as that of the flow passage structure body 11 according to the foregoing first embodiment except that, firstly, its stack is composed of layers Su1 to Su5, and, secondly, it has a different shape. Therefore, the flow passage structure body 11C has a structure for reducing the stay of air bubbles, similarly to the flow passage structure body 11. This structure will be described in detail later.

The wiring board 12C is a mount component for electrically connecting the head bodies 14_1, 14_2, 14_3, and 14_4 to the control unit 20. For example, the wiring board 12C is a flexible wiring board or a rigid wiring board, etc. The wiring board 12C is disposed between the flow passage structure body 11C and the cover 18. The wiring board 12C has a surface facing the flow passage structure body 11C. On the surface that is the opposite of this surface, the connector 12*c* is provided. The connector 12*c* is a connection component for electric connection to the control unit 20. The wiring board 12C is electrically connected to the plurality of head bodies 14 via wiring that is not illustrated. The wiring is, for example, configured as a combination of a flexible wiring board and a rigid wiring board. The wiring may be configured as a part of the wiring board 12C integrally.

Except for a difference in shape, the holder 13C is the same as the holder 13 according to the foregoing first embodiment. Except for a difference in shape, the fixing plate 15C is the same as the fixing plate 15 according to the foregoing first embodiment. However, the reinforcing plate 17 is disposed between the holder 13C and the fixing plate 15C. In FIG. 14, a structure in which the holder 13C does not include any branch flow passage is illustrated.

The reinforcing plate 17 is a plate-like member for reinforcement of the fixing plate 15C. The reinforcing plate 17 is stacked on the fixing plate 15C and is fixed to the fixing plate 15C with an adhesive. The reinforcing plate 17 has a plurality of openings inside which the plurality of head bodies 14 is disposed. The reinforcing plate 17 is made of, for example, a metal material, etc.

The cover 18 is a box-type member that houses the flow passage member 1C of the flow passage structure body 11C and the wiring board 12C. The cover 18 is made of, for example, a resin material, etc. The cover 18 has four through holes 18*a* and an opening 18*b*. These four through holes 18*a* correspond to four connection pipes of the flow passage structure body 11C. The corresponding connection pipe 11*a*, 11*b*, 11*c*, or 11*d* is inserted through each of these four through holes 18*a*. The connector 12*c* is inserted through the opening 18*b* from the inside to the outside of the cover 18.

Figure 15:
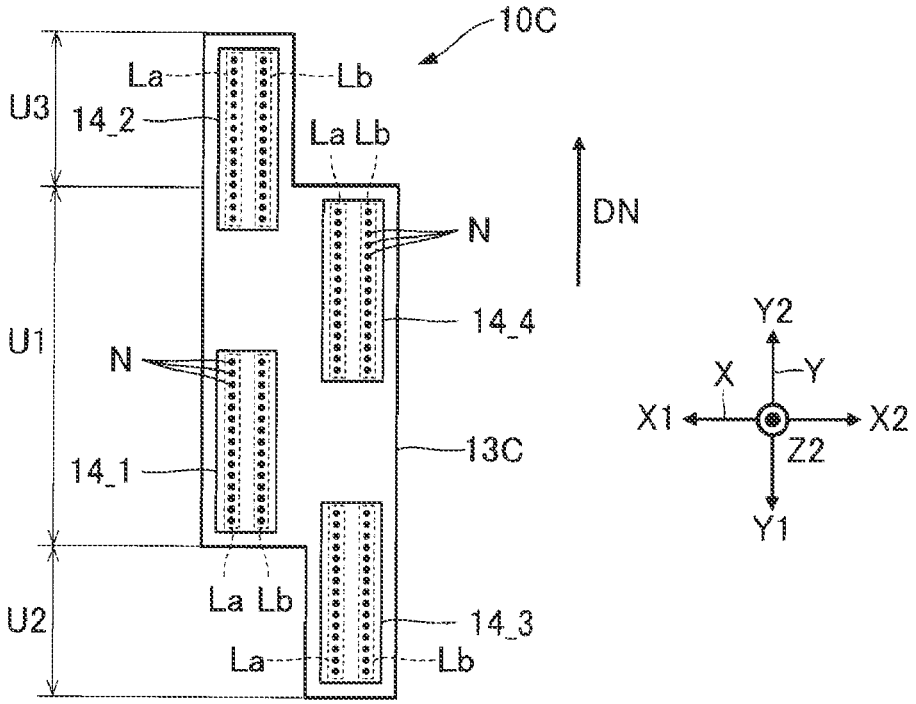
FIG. 15 is a diagram for explaining the layout of nozzles in the liquid ejecting head illustrated in FIG. 13.

FIG. 15 is a diagram for explaining the layout of the nozzles N in the liquid ejecting head 10C illustrated in FIG. 13. As illustrated in FIG. 15, the liquid ejecting head 10C includes a first portion U1, a second portion U2, and a third portion U3. The first portion U1 is located between the second portion U2 and the third portion U3. The width of each of the second portion U2 and the third portion U3 along the X axis is less than the width of the first portion U1 along the X axis. In the example illustrated in FIG. 15, the width of the second portion U2 along the X axis and the width of the third portion U3 along the X axis are equal to each other. The end face of the first portion U1 in the X1 direction is a plane that is continuous to the end face of the third portion U3 in the X1 direction. On the other hand, the end face of the first portion U1 in the X2 direction is a plane that is continuous to the end face of the second portion U2 in the X2 direction. Concave portions or convex portions may be provided in or on these end faces. These end faces may be stepped.

As illustrated in FIG. 15, the holder 13C holds four head bodies 14_1 to 14_4. The head body 14_1 is located in the first portion U1 described above at a relatively Y1-directional position in relation to the head body 14_2. A part of the head body 14_2 is located in the third portion U3. The rest of the head body 14_2 is located in the first portion U1. Similarly, the head body 14_4 is located in the first portion U1 at a relatively Y2-directional position in relation to the head body 14_3. A part of the head body 14_3 is located in the second portion U2. The rest of the head body 14_3 is located in the first portion U1.

In the liquid ejecting head 10C, in which the head bodies 14_1 to 14_4 are arranged as explained above, the Y1-side end of the nozzle row La of the head body 14_2 and the Y2-side end of the nozzle row La of the head body 14_4 overlap with each other as viewed in the X-axis direction. The same relationship holds between the head body 14_4 and the head body 14_1, and between the head body 14_1 and the head body 14_3. The same relationship holds for the nozzle rows Lb, too. Therefore, the nozzle rows La of the head bodies 14_1 to 14_4 are arranged without any Y-directional clearance, and the nozzle rows Lb of the head bodies 14_1 to 14_4 are also arranged without any Y-directional clearance. Therefore, it is possible to increase an effective print width in the Y-axis direction of the liquid ejecting head 10C.

Figure 16:
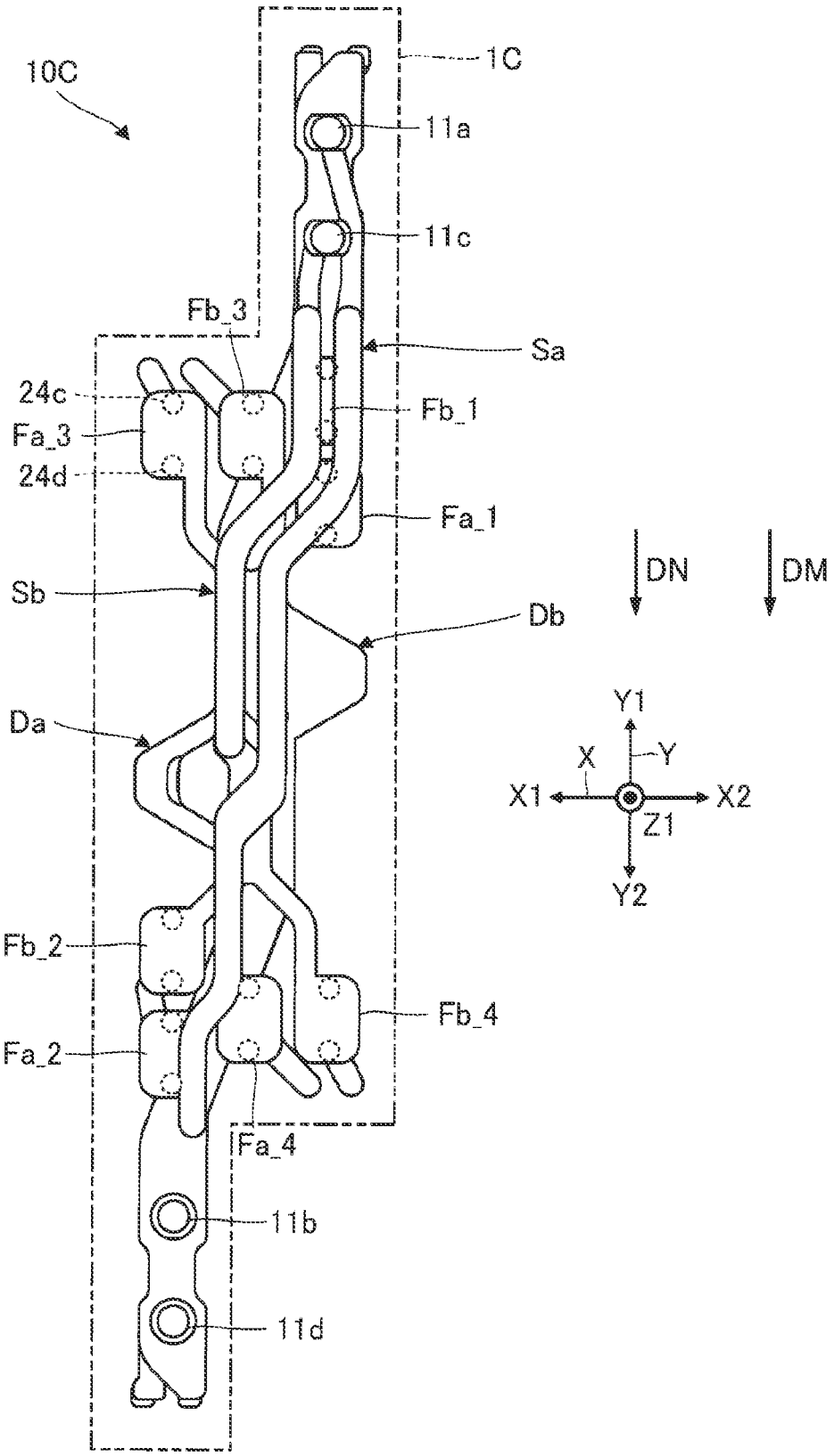
FIG. 16 is a diagram that illustrates an example of the structure of a flow passage member according to the fourth embodiment.
Figure 17:
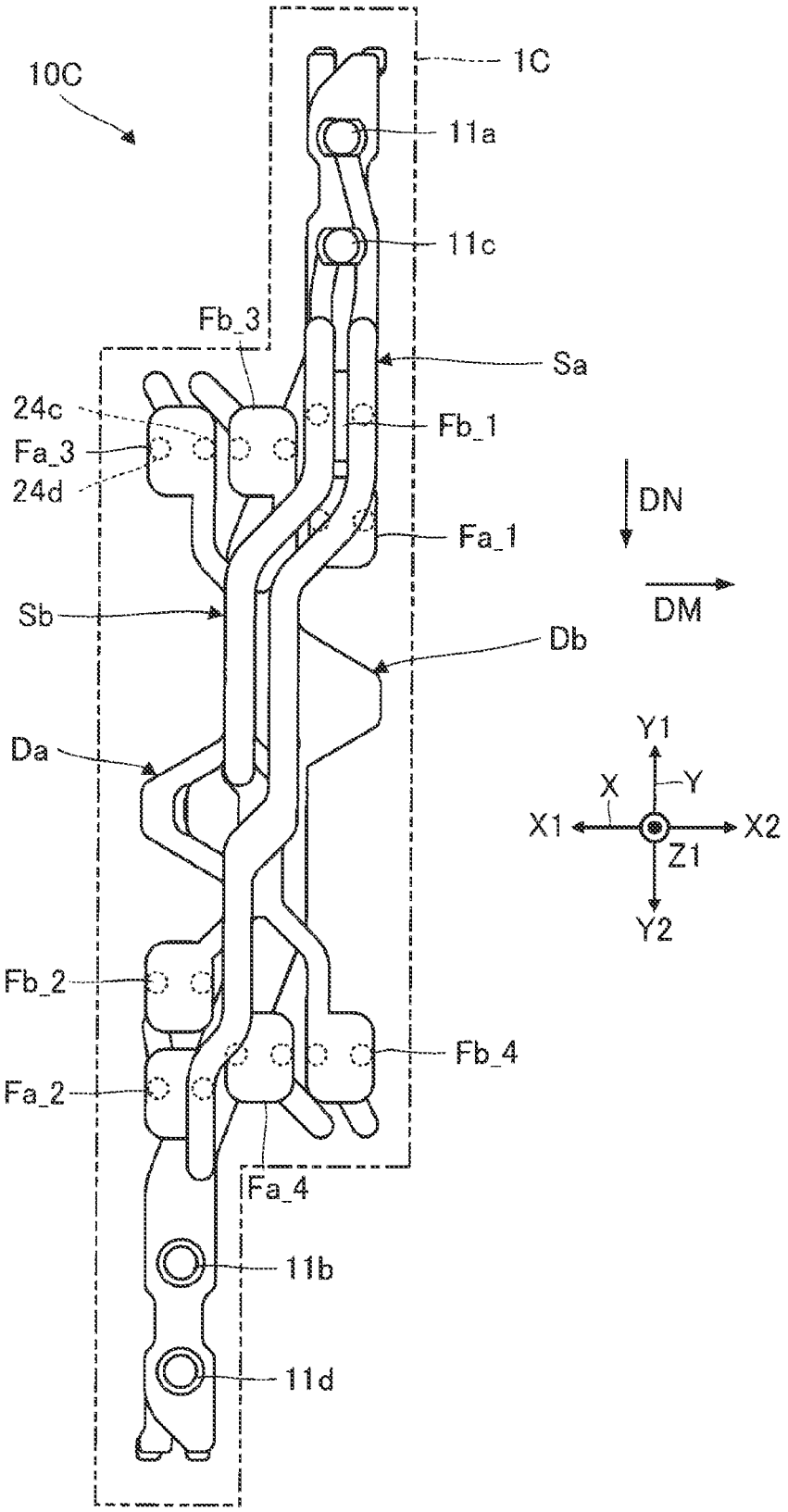
FIG. 17 is a diagram that illustrates an example of the structure of the flow passage member according to the fourth embodiment.

Each of FIGS. 16 and 17 is a diagram that illustrates an example of the structure of the flow passage member 1C according to the fourth embodiment. As illustrated in FIGS. 16 and 17, a supply flow passage Sa, a discharge flow passage Da, a supply flow passage Sb, and a discharge flow passage Db are provided inside the flow passage member 1C. The supply flow passage Sa is a flow passage leading from the connection pipe 11*a* to the liquid reservoir Ra of each of the plurality of head bodies 14. The supply flow passage Sa is an example of "a common flow passage". The discharge flow passage Da is a flow passage leading from the liquid reservoir Ra of each of the plurality of head bodies 14 to the connection pipe 11*b*. The supply flow passage Sb is a flow passage leading from the connection pipe 11*c* to the liquid reservoir Rb of each of the plurality of head bodies 14. The supply flow passage Sb is an example of "a common flow passage". The discharge flow passage Db is a flow passage leading from the liquid reservoir Rb of each of the plurality of head bodies 14 to the connection pipe 11*d*. These flow passages are formed by providing grooves and through holes in the layers Su1 to Su5 described above.

As illustrated in FIGS. 16 and 17, four filter portions Fa_1 to Fa_4 are provided for the supply flow passage Sa. Similarly, four filter portions Fb_1 to Fb_4 are provided for the supply flow passage Sb. Each of these filter portions Fa_1 to Fa_4 and filter portions Fb_1 to Fb_4 has the same structure as that of the filter 25 and its periphery according to the foregoing first embodiment.

When the liquid ejecting head 10C is used for a serial printer according to the foregoing third embodiment whose main scan direction is the X-axis direction, the increase in the effective print width in the transportation direction of the medium 101 makes it possible to increase the size of an image formed on the medium 101 while the carriage 61 goes and returns in one cycle of reciprocation, thereby increasing the speed of print operation.

Therefore, when the liquid ejecting head 10C is applied to the serial-type configuration according to the foregoing third embodiment, the liquid ejecting head 10C is oriented in such a manner that the direction DN in which the nozzles N are arranged is in parallel with the direction DM in which the medium 101 is transported. In such a case, similarly to the third embodiment, there is a possibility that the liquid ejecting head 10C is used in a state in which the nozzle face FN is inclined around the axis extending in the direction in which the carriage 61 reciprocates. Therefore, in this case, a structure in which the first outlet 24*c* and the second outlet 24*d* are arranged in the Y1 direction or the Y2 direction in each of the filter portions Fa_1 to Fa_4 and filter portions Fb_1 to Fb_4 is used, as in an example illustrated in FIG. 16.

On the other hand, when the liquid ejecting head 10C is used for a line head that is elongated along the X axis as in the foregoing first embodiment or the foregoing second embodiment, it is possible to configure the line head by designing such that the X-axis direction that is the length direction of the liquid ejecting head 10C is orthogonal to the transportation direction DM and such that the effective print width is greater than the size of the medium 101 in the width direction.

Therefore, when the liquid ejecting head 10C is applied to a line head according to the foregoing first embodiment or the foregoing second embodiment, the liquid ejecting head 10C is oriented in such a manner that the direction DN in which the nozzles N are arranged is orthogonal to the direction DM in which the medium 101 is transported. In such a case, similarly to the first, second embodiment, there is a possibility that the liquid ejecting head 10C is used in a state in which the nozzle face FN is inclined around the axis extending in the direction in which the line head is elongated. Therefore, in this case, a structure in which the first outlet 24*c* and the second outlet 24*d* are arranged in the X1 direction or the X2 direction in each of the filter portions Fa_1 to Fa_4 and filter portions Fb_1 to Fb_4 is used, as in an example illustrated in FIG. 17.

Even when configured as in the fourth embodiment described above, it is possible to reduce the stay of air bubbles, similarly to the foregoing first to third embodiments.

5. Variation Examples

The embodiments described as examples above can be modified in various ways. Some specific examples of modification that can be applied to the embodiments described above are described below. Two or more variation examples selected arbitrarily from the description below may be combined as long as they are not contradictory to each other or one another.

5-1. First Variation Example

Figure 18:
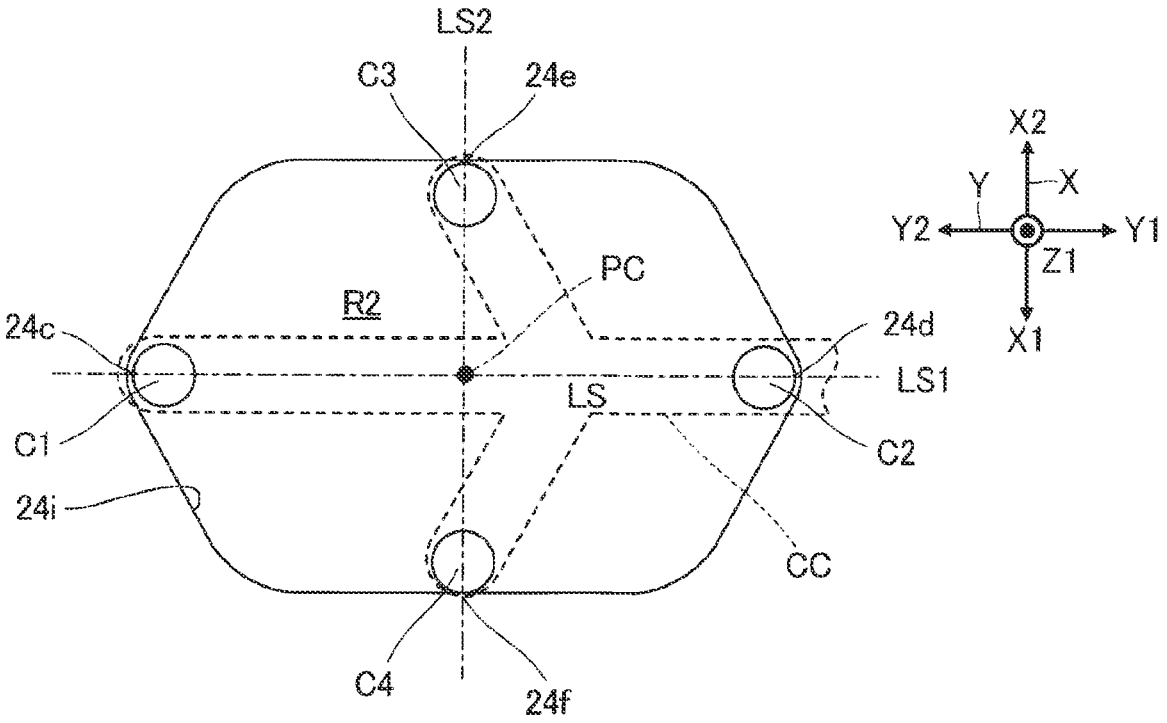
FIG. 18 is a schematic view of a downstream chamber and outlets according to a first variation example.

FIG. 18 is a schematic view of the downstream chamber R2, the first outlet 24*c*, the second outlet 24*d*, a third outlet 24*e*, and a fourth outlet 24*f* according to a first variation example. In the first variation example, the downstream chamber R2 has the third outlet 24*e* and the fourth outlet 24*f* as additional openings in addition to the first outlet 24*c* and the second outlet 24*d*.

The third outlet 24*e* allows ink to flow out through itself to a third flow passage C3 which is a passage for communication between the downstream chamber R2 and the common flow passage CC. Therefore, the third flow passage C3 is in communication with the downstream chamber R2 via the third outlet 24*e*. In the example illustrated in FIG. 18, the third outlet 24*e* is located at a position that does not overlap with a virtual straight line LS going through the first outlet 24*c* and the second outlet 24*d* in plan view. Therefore, it is possible to cause air bubbles to exit not only in a case where the downstream chamber R2 is inclined around the axis that is in parallel with the X axis as disclosed in the first embodiment but also in a case where the downstream chamber R2 is inclined around the axis that is in parallel with the Y axis, wherein the air bubbles exit through the third outlet 24*e* in the latter case. In FIG. 18, the shape of the common flow passage CC is indicated by broken lines. In the example illustrated in FIG. 18, the common flow passage CC has a branched shape. However, the shape of the common flow passage CC is not limited to the example illustrated in FIG. 18. In this respect, the shape of the common flow passage CC illustrated in FIGS. 19 to 22 described below is also not limited to the illustrated shape.

The fourth outlet 24*f* allows ink to flow out through itself to a fourth flow passage C4 which is a passage for communication between the downstream chamber R2 and the common flow passage CC. Therefore, the fourth flow passage C4 is in communication with the downstream chamber R2 via the fourth outlet 24*f*. In the example illustrated in FIG. 18, the third outlet 24*e* and the fourth outlet 24*f* are located at positions that are the opposite of each other with respect to the straight line LS in plan view. Therefore, it is possible to cause air bubbles to exit through the third outlet 24*e* or the fourth outlet 24*f* regardless of which one of the two directions the downstream chamber R2 is inclined in around the axis that is parallel with the Y axis.

As illustrated in FIG. 18, the first outlet 24*c* and the second outlet 24*d* are located on a first straight line LS1 in plan view. The first straight line LS1 is a virtual straight line that goes through the center PC of the downstream chamber R2 in plan view and extends in the Y2 direction. The third outlet 24*e* and the fourth outlet 24*f* are located on a second straight line LS2 in plan view. The second straight line LS2 is a virtual straight line that goes through the center PC of the downstream chamber R2 and extends in the X1 direction or the X2 direction. As described above, the third outlet 24*e* and the fourth outlet 24*f* are arranged in addition to the first outlet 24*c* and the second outlet 24*d*. Therefore, it is possible to cause air bubbles to exit through any one of these outlets properly regardless of the orientation of inclination of the downstream chamber R2.

5-2. Second Variation Example

Figure 19:
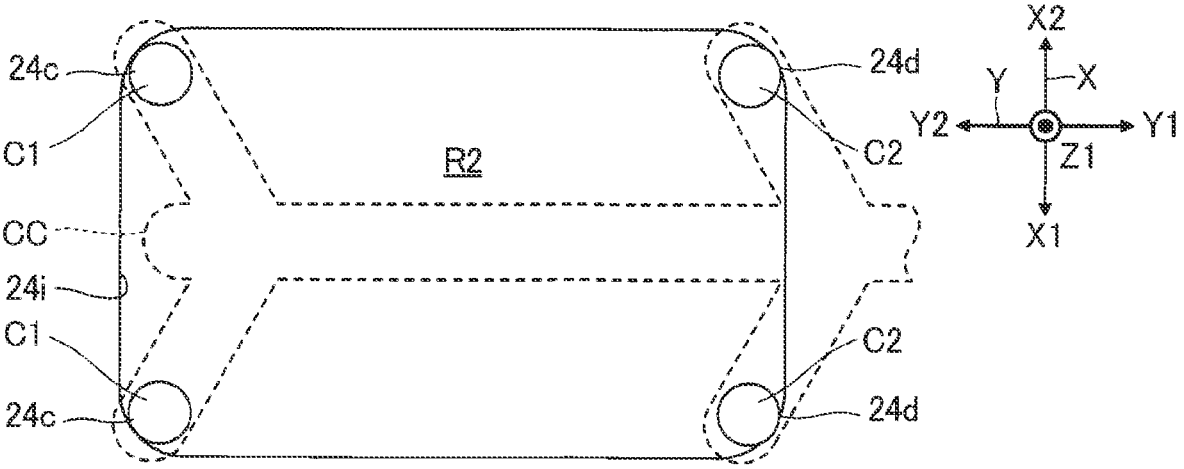
FIG. 19 is a schematic view of a downstream chamber and outlets according to a second variation example.

FIG. 19 is a schematic view of the downstream chamber R2, the first outlets 24*c*, and the second outlets 24*d* according to a second variation example. In the second variation example, the shape of the downstream chamber R2 in plan view is closer to a quadrangle in comparison with the first variation example. In addition, two first outlets 24*c* and two second outlets 24*d* are provided in the downstream chamber R2. These outlets are provided near the four corners of the downstream chamber R2 respectively. Even when configured as in the second variation example described above, the same effects as those of the foregoing first embodiment, or similar effects, can be obtained. One of the two first outlets 24*c* may be regarded as the third outlet or the fourth outlet. Similarly, one of the two second outlets 24*d* may be regarded as the third outlet or the fourth outlet.

5-3. Third Variation Example

Figure 20:
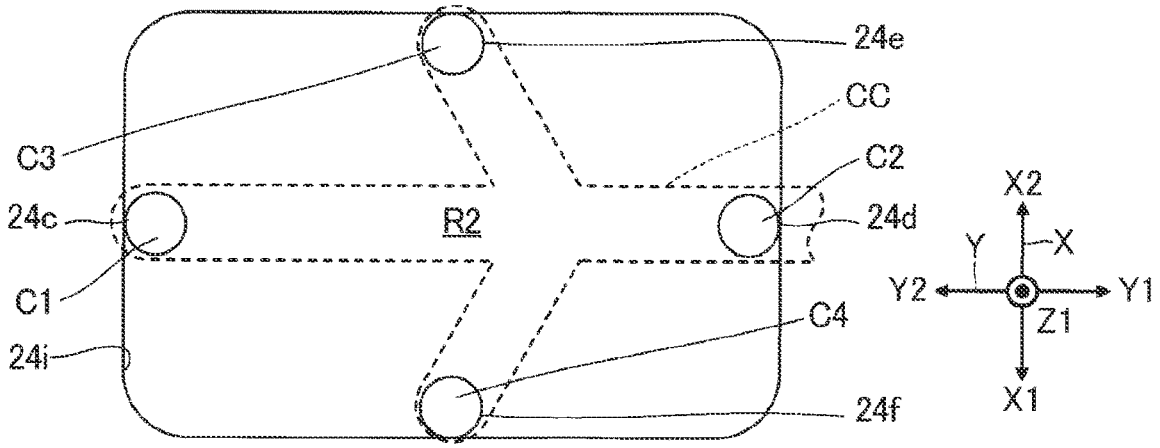
FIG. 20 is a schematic view of a downstream chamber and outlets according to a third variation example.

FIG. 20 is a schematic view of the downstream chamber R2, the first outlet 24*c*, the second outlet 24*d*, the third outlet 24*e*, and the fourth outlet 24*f* according to a third variation example. The third variation example is the same as the first variation example except that the shape of the downstream chamber R2 in plan view is the same as that of the second variation example. Even when configured as in the third variation example described above, the same effects as those of the foregoing first embodiment, or similar effects, can be obtained.

5-4. Fourth Variation Example

Figure 21:
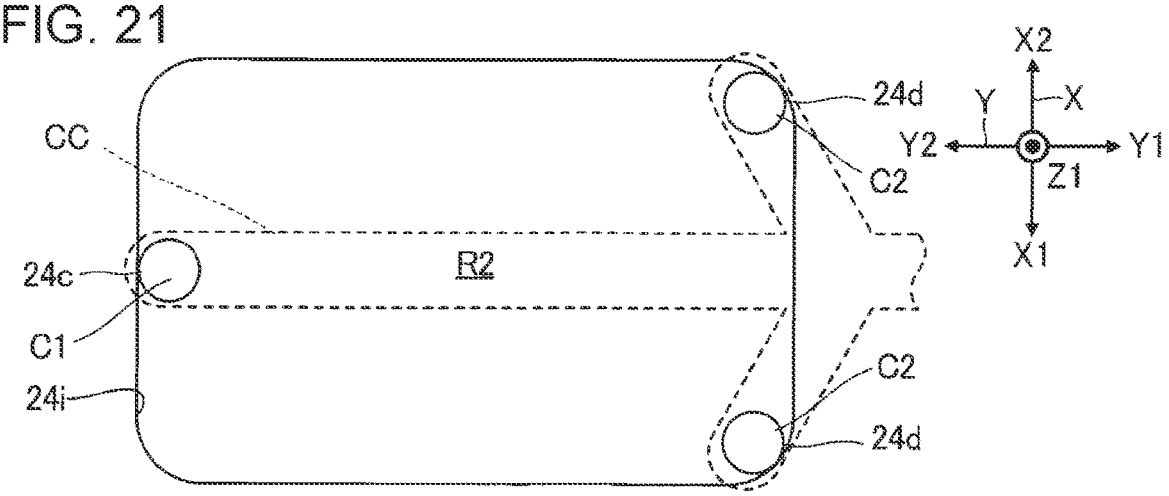
FIG. 21 is a schematic view of a downstream chamber and outlets according to a fourth variation example.

FIG. 21 is a schematic view of the downstream chamber R2, the first outlet 24*c*, and the second outlets 24*d* according to a fourth variation example. In the fourth variation example, the shape of the downstream chamber R2 in plan view is the same as that of the second variation example. In addition, two second outlets 24*d* are provided in the downstream chamber R2. The two second outlets 24*d* are provided respectively near, among the four corners of the downstream chamber R2, two corners that are more distant from the first outlet 24*c* than the other two corners are. Even when configured as in the fourth variation example described above, the same effects as those of the foregoing first embodiment, or similar effects, can be obtained. One of the two second outlets 24*d* may be regarded as the third outlet.

5-5. Fifth Variation Example

Figure 22:
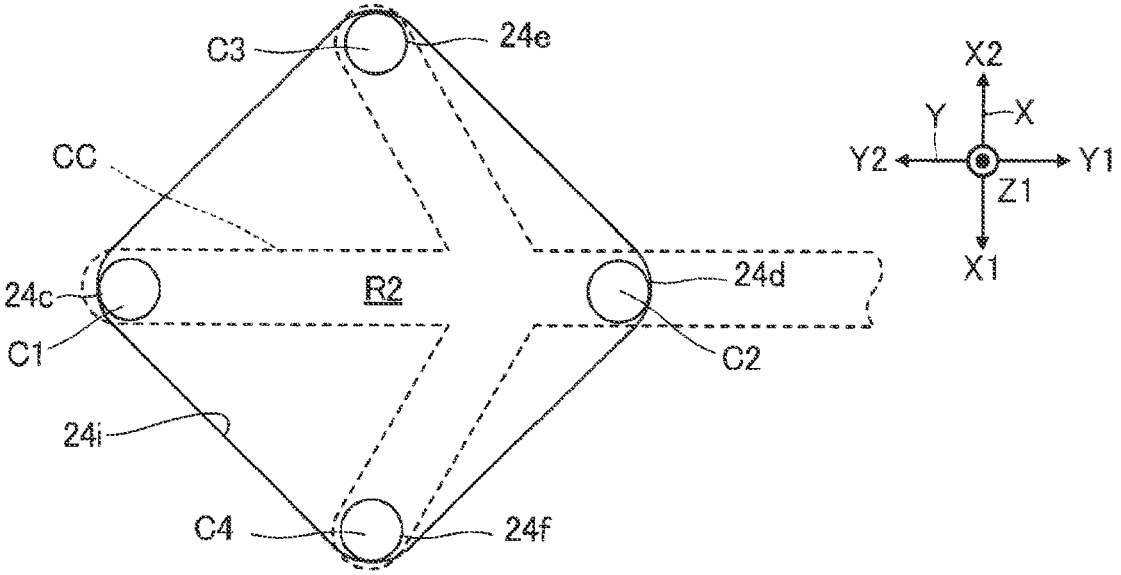
FIG. 22 is a schematic view of a downstream chamber and outlets according to a fifth variation example.

FIG. 22 is a schematic view of the downstream chamber R2, the first outlet 24*c*, the second outlet 24*d*, the third outlet 24*e*, and the fourth outlet 24*f* according to a fifth variation example. In the fifth variation example, the shape of the downstream chamber R2 in plan view is closer to a square in comparison with the third variation example. In addition, these outlets are provided near the four corners of the downstream chamber R2 respectively. Even when configured as in the fifth variation example described above, the same effects as those of the foregoing first embodiment, or similar effects, can be obtained. In the fifth variation example, even when there are a possibility of inclination around the X axis and a possibility of inclination around the Y axis, in both cases, it is possible to cause air bubbles to exit through the first outlet 24*c*, the second outlet 24*d*, the third outlet 24*e*, or the fourth outlet 24*f* properly. In the fifth variation example, sidewalls 24*i* form a square-like shape in plan view, and the first outlet 24*c*, the second outlet 24*d*, the third outlet 24*e*, and the fourth outlet 24*f* are provided respectively near the four corners of the square. Therefore, as compared with the structure according to the first to fourth variation examples in which an outlet is located at a non-corner position near a side defined by the sidewall 24*i*, it is easier to guide air bubbles to any one of these outlets regardless of how the downstream chamber R2 is inclined. For this reason, it is possible to prevent the stay of air bubbles effectively.

5-6. Sixth Variation Example

In the structure disclosed as an example in the foregoing second embodiment, ink is ejected from the liquid ejecting module 40 directly onto the medium 101 adsorbed on the circumferential surface of the drum 31. However, the drum 31 may be used as a transfer member through the intermediary of which ink ejected from the liquid ejecting module 40 is transferred to the medium 101. In this case, ink is ejected from the liquid ejecting module 40 with no medium 101 adsorbed on the circumferential surface of the drum 31, and, after the ejection, the ink is transferred from the circumferential surface of the drum 31 to the medium 101.

5-7. Seventh Variation Example

The liquid ejecting apparatus 100 disclosed as examples in the foregoing exemplary embodiments can be applied to not only print-only machines but also various kinds of equipment such as facsimiles and copiers, etc. The scope of application of a liquid ejecting apparatus according to the present disclosure is not limited to printing. For example, a liquid ejecting apparatus that ejects a colorant solution can be used as an apparatus for manufacturing a color filter of a liquid crystal display device. A liquid ejecting apparatus that ejects a solution of a conductive material can be used as a manufacturing apparatus for forming wiring lines and electrodes of a wiring substrate.

What is claimed is:

1. A liquid ejecting head, comprising:

a nozzle face having nozzles configured to eject liquid;

a filter through which the liquid passes;

a downstream chamber that includes a first outlet and a second outlet for discharging the liquid, the downstream chamber being located downstream of the filter, the filter constituting a part of a wall surface of the downstream chamber;

a first flow passage that is in communication with the downstream chamber through the first outlet;

a second flow passage that is in communication with the downstream chamber through the second outlet; and a common flow passage that is in communication with the first flow passage and the second flow passage, wherein one end of the first flow passage is connected to the first outlet, one end of the second flow passage is connected to the second outlet, the other end of the first flow passage and the other end of the second flow passage are connected to the common flow passage, and in plan view perpendicular to the nozzle face, the first outlet is located at a position that is shifted from a center of the downstream chamber in a first direction, and the second outlet is located at a position that is shifted from the center of the downstream chamber in a second direction that is opposite of the first direction.

2. The liquid ejecting head according to claim 1, wherein an area size of the first outlet and an area size of the second outlet are equal to each other.

3. The liquid ejecting head according to claim 1, wherein a distance from the center of the downstream chamber to the first outlet and a distance from the center of the downstream chamber to the second outlet are equal to each other.

4. The liquid ejecting head according to claim 1, further comprising:

a bottom wall that, together with the filter, demarcates the downstream chamber, and faces the filter; wherein the first outlet is provided in the bottom wall.

5. The liquid ejecting head according to claim 4, wherein a distance between the first outlet and the filter is longer than a distance between the bottom wall at the center of the downstream chamber in the plan view and the filter.

6. The liquid ejecting head according to claim 1, wherein the first outlet is located at an end portion of the downstream chamber in the first direction, and the second outlet is located at an end portion of the downstream chamber in the second direction.

7. The liquid ejecting head according to claim 6, wherein in the plan view, the first outlet is closer to the first end portion than to the center, and the second outlet is closer to the second end portion than to the center.

8. The liquid ejecting head according to claim 1, further comprising:

an upstream chamber that includes an inlet through which the liquid flows in, the upstream chamber being located upstream of the filter, the filter constituting a part of a wall surface of the upstream chamber; wherein in the plan view, the inlet is located between the first outlet and the second outlet.

9. The liquid ejecting head according to claim 1, further comprising:

a third flow passage for communication between the downstream chamber and the common flow passage; wherein the downstream chamber includes a third outlet for discharging the liquid to the third flow passage, and the third outlet is located at a position that does not overlap with a virtual straight line going through the first outlet and the second outlet in the plan view.

10. The liquid ejecting head according to claim 1, the liquid ejecting head being a constituent of a line head, wherein the first direction intersects with a direction in which the line head is elongated.

11. A liquid ejecting apparatus, comprising:

the liquid ejecting head according to claim 1; and a transport mechanism that transports a medium in the first direction or the second direction at a position facing the liquid ejecting head.

12. A liquid ejecting apparatus according to claim 11, comprising:

at least one line head that includes the liquid ejecting head as a constituent and is elongated in a direction intersecting with the first direction or the second direction.

13. The liquid ejecting apparatus according to claim 12, wherein the at least one line head includes a first line head; and a second line head located upstream of or downstream of the first line head on a transportation path of the medium, the first line head is arranged with an inclination such that an end of the nozzle face in the first direction is located above an end of the nozzle face in the second direction, and the second line head is arranged with an inclination such that an end of the nozzle face in the first direction is located below an end of the nozzle face in the second direction.

14. The liquid ejecting apparatus according to claim 13, wherein an angle of inclination of the nozzle face of the first line head with respect to a horizontal plane and an angle of inclination of the nozzle face of the second line head with respect to the horizontal plane are equal to each other.

15. The liquid ejecting apparatus according to claim 11, further comprising:

a carriage that supports the liquid ejecting head and reciprocates along an axis extending in a direction intersecting with the first direction.

16. A liquid ejecting head, comprising:

a nozzle face having nozzles configured to eject liquid;

a filter through which the liquid passes;

a downstream chamber that includes a first outlet, a second outlet, and a third outlet for discharging the liquid, the downstream chamber being located downstream of the filter, the filter constituting a part of a wall surface of the downstream chamber;

a first flow passage that is in communication with the downstream chamber through the first outlet;

a second flow passage that is in communication with the downstream chamber through the second outlet;

a third flow passage that is in communication with the downstream chamber through the third outlet; and a common flow passage that is in communication with the first flow passage, the second flow passage, and the third flow passage, wherein one end of the first flow passage is connected to the first outlet, one end of the second flow passage is connected to the second outlet, one end of the third flow passage is connected to the third outlet, and the other end of the first flow passage, the other end of the second flow passage, and the other end of the third flow passage are connected to the common flow passage.

17. The liquid ejecting head according to claim 16, wherein in plan view perpendicular to the nozzle face, the first outlet is located at a position that is shifted from a center of the downstream chamber in a first direction, the second outlet is located at a position that is shifted from the center of the downstream chamber in a second direction that is opposite of the first direction, and the third outlet is located at a position that does not overlap with a virtual straight line going through the first outlet and the second outlet.

18. The liquid ejecting head according to claim 17, further comprising:

a fourth flow passage for communication between the downstream chamber and the common flow passage; wherein the downstream chamber includes a fourth outlet for discharging the liquid to the fourth flow passage, and the third outlet and the fourth outlet are located at positions that are opposite of each other with respect to the straight line in the plan view.

19. The liquid ejecting head according to claim 18, wherein a virtual straight line that goes through the center of the downstream chamber in the plan view and extends in the first direction is defined as a first straight line, a virtual straight line that goes through the center of the downstream chamber in the plan view and extends in a third direction orthogonal to the first direction is defined as a second straight line, given the above definition, the first outlet and the second outlet are located on the first straight line in the plan view, and the third outlet and the fourth outlet are located on the second straight line in the plan view.

20. A liquid ejecting apparatus, comprising:

the liquid ejecting head according to claim 16; and a transport mechanism that transports a medium.

* * * * *